US007500301B2

(12) United States Patent
Cassaday

(10) Patent No.: US 7,500,301 B2
(45) Date of Patent: Mar. 10, 2009

(54) METHOD OF CLAMPING PAPER IN A PAPER CLIP

(75) Inventor: Terry Cassaday, Toronto (CA)

(73) Assignee: Ergo Industrial Seating Systems Inc, Mississauga (CA)

( * ) Notice: Subject to any disclaimer, the term of this patent is extended or adjusted under 35 U.S.C. 154(b) by 50 days.

(21) Appl. No.: 10/555,375

(22) PCT Filed: Apr. 30, 2004

(86) PCT No.: PCT/CA2004/000647

§ 371 (c)(1),
(2), (4) Date: Nov. 2, 2005

(87) PCT Pub. No.: WO2004/096574

PCT Pub. Date: Nov. 11, 2004

(65) Prior Publication Data

US 2006/0242801 A1 Nov. 2, 2006

(51) Int. Cl.
*B42F 1/02* (2006.01)

(52) U.S. Cl. ..... 29/446; 24/489; 24/328

(58) Field of Classification Search ..... 24/489, 24/333, 328, 170, 67.11, 67 R; 29/446
See application file for complete search history.

(56) References Cited

U.S. PATENT DOCUMENTS

| | | | | | |
|---|---|---|---|---|---|
| 3,608,158 | A | * | 9/1971 | Bengtsson | 24/170 |
| 4,172,543 | A | * | 10/1979 | Fischer | 224/268 |
| 4,397,577 | A | * | 8/1983 | Bauer | 402/19 |
| 4,562,618 | A | * | 1/1986 | Masuda | 24/67.7 |
| 5,384,935 | A | * | 1/1995 | Maier-Hunke et al. | 24/67 R |
| 5,533,236 | A | * | 7/1996 | Tseng | 24/67.5 |
| 5,842,256 | A | * | 12/1998 | Anscher | 24/3.4 |
| 6,018,850 | A | * | 2/2000 | Lorber | 24/67.9 |
| 6,381,810 | B2 | * | 5/2002 | Hsieh | 24/170 |

FOREIGN PATENT DOCUMENTS

| | | | | |
|---|---|---|---|---|
| EP | 510981 | A1 | * | 10/1992 |
| WO | WO 9500344 | A1 | * | 1/1995 |

* cited by examiner

*Primary Examiner*—Jermie E Cozart
(74) *Attorney, Agent, or Firm*—Miller Thomson LLP; Eugene Gigrczak

(57) ABSTRACT

A method of clamping paper in a paper clip is disclosed where the paper clip has spaced first and second opposed surfaces connected together at a rear edge and a cam member having a tab at one end thereof and a cam surface at another end thereof whereby the tab is moved between an open and closed position. The first and second opposed surfaces comprised of bent metal.

5 Claims, 28 Drawing Sheets

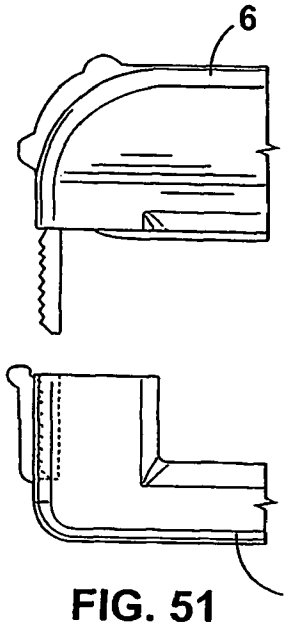
FIG. 51
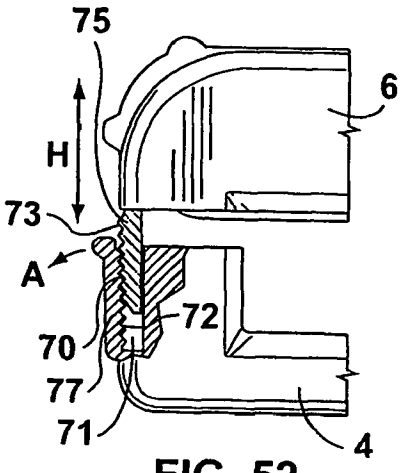
FIG. 52
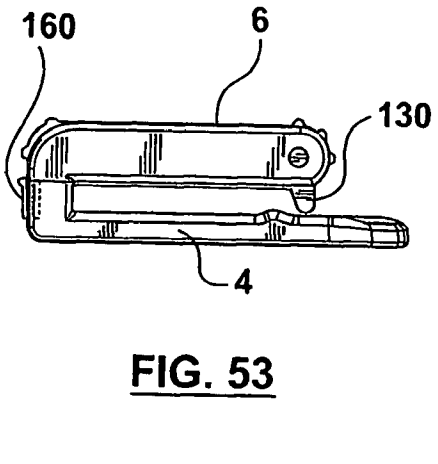
FIG. 53
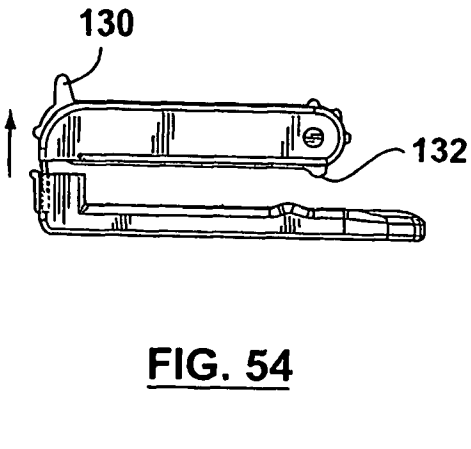
FIG. 54
FIG. 55
FIG. 56
FIG. 57

METHOD OF CLAMPING PAPER IN A PAPER CLIP

FIELD OF INVENTION

This invention relates to a clip for securing sheet material having a base and a rotatably movable cam member; and particularly relates to paper clips for securing paper between first and second opposed surfaces and a displaceable cam member, and includes the method of clamping said paper therebetween. Another aspect of the invention relates to a clip having at least two reversible cam members, as well as a paper clip that can accommodate a variable thickness of paper.

BACKGROUND ART

There have been a variety of fastening devices for fastening, clamping, or gripping substantially flat articles such as sheet material or the like. Such fastening devices can include clipboards, staples, paper clips and the like for holding, fastening or clamping a plurality of sheets, fabric, paper or other material. Clips can also be used to fasten one item to another, attach one item to another or hand one item to another.

In particular it is well known to employ staples as well as paper clips to bold sheets of paper together such as the standard metal oblong-shaped paper clip or the metallic clamping paper clip having two pressure bearing legs that must be separated to insert paper there between. Such metal paper clips and staples can damage paper.

Moreover a piece of paper can inadvertently get snagged in the prior art oblong-shaped paper clip which is attached to other papers and thereby be incorrectly filed.

Furthermore many paper clips do not get used as paper clips particularly the wire paper clips which often get extended to clean articles or bent out of shape in a mechanical form of doodling.

These and other prior art devices such as the spring wire clip formed from spring steel wire having a triangular head with a pair of forwardly and inwardly extending legs have been disclosed in U.S. Pat. No. 4,299,013.

Moreover U.S. Pat. No. 4,440,374 relates to a resilient clip for supporting elongated articles where a base has an integrally formed flexible arm.

Another arrangement is shown in U.S. Pat. No. 5,056,197 which relates to a clip of extruded plastic material.

Yet other plastics clips are disclosed in U.S. Pat. No. 5,400,483 while U.S. Pat. No. 5,479,682 relates to a clamp comprising a U-shaped body having a web and two legs for clamping paper sheets.

Other clip arrangements are shown in U.S. Pat. Nos. 5,479,682, 6,260,244 which relates to a plastic clip; U.S. Pat. No. 6,163,934 which illustrates a multi-purpose paper clip; U.S. Pat. No. 6,018,850 which shows a clip for sheets of paper, and U.S. Pat. No. 5,214,825 which illustrates a paper clip with multiple panels.

Clips have also been used to bind paper together as shown in U.S. Pat. Nos. 5,758,902, 5,542,708, 5,626,432, 4,174,910 and 5,320,456.

Other arrangements are shown in U.S. Pat. Nos. 6,612,532 B1, 6,374,463 B1 and 5,845,889.

It is an object of this invention to provide an improved paper clip which is easy to manufacture and use.

SUMMARY OF INVENTION

It is an aspect of this invention to provide a clip for securing sheet material comprising a base; a cam member operably connected to said base for displaceable movement between; an open position for insertion of said sheet material between said base and said cam member; a closed position for gripping said sheet material between said base and said cam.

It is another aspect of this invention to provide a paper clip for securing paper comprising first and second opposed surfaces, each having a forward and rear edge, and connected together at said rear edge, to permit insertion of said paper through said front edge between said first and second surfaces; a cam member pivotally connected to said front edge of said second surface for displaceable movement between; an open position where said cam member is displaced away from said first surface to permit insertion of said paper between said first and second surfaces, and a closed position where said cam member is displaced towards said first member to clamp said paper between said cam member and said second surface.

It is yet a further aspect of this invention to provide a method of clamping paper in a paper clip having spaced first and second opposed surfaces, each first and second opposed surface having a forward and rear edge, and connected together at said rear edge, and a cam member having a tab at one end thereof and a cam surface at another end thereof comprising the steps of moving said tab to a first open position where said cam surface is displaced away from said first surface; inserting paper through said forward edge between the said first and second opposed surfaces; moving said tab to a closed position whereby said cam surface is displaced towards said first surface to clamp said paper between said cam surface and said second opposed surface.

Another aspect of this invention is to provide a clip having a base and rotatably moveable members presenting at least two reversible cam members to provide for a clip capable of securing at least two, different thicknesses of sheet material therebetween.

It is another aspect of this invention to provide paper clips which are selectively stackable to increase the number of papers that can be secured therebetween.

Another embodiment of the invention provides paper clips for securing paper between first and second opposed surfaces which are selectively ratcheted relative one another.

It is an aspect of this invention to provide a clip for securing sheet material comprising a base, a rotatable member presenting at least two reversible cam members for displaceable movement between an open position for insertion of said sheet material between said base and said cam member; a first closed position for gripping a first thickness of sheet material between said base and said first reversible cam member; and a second closed position for gripping a second thickness of sheet material between said base and said second reversible cam member.

It is a further aspect of this invention to provide a paper clip for securing at least two thicknesses of paper comprising first and second opposed surfaces, each having a forward and rear edge and connected together at said rear edge to permit insertion of said paper through said front edge between said first and second surfaces; at least two cam members pivotally connected to said front and rear edge of said second surface for displaceable movement therebetween an open position where said cam members are displaced away from said first surface to permit insertion of said thicknesses of paper between said first and second surfaces; and a first closed position where said first cam member is displaced towards said first member to clamp said first thickness of paper between said first cam member and said second surface; a second closed position where said second cam member is displaced towards said first member to clamp said second thickness of paper between said second cam member and said second surface.

BRIEF DESCRIPTION OF DRAWINGS

FIG. 51 is a side elevational view of another embodiment of the invention showing an adjustable thickness feature.

FIG. 52 is a side elevational view of another embodiment of the invention in FIG. 51 with a ratchet mechanism partially engaged.

FIG. 53 is a side elevational view of another embodiment of the invention.

FIG. 54 is a side elevational view of another embodiment of the invention showing a clip having a first cam and an adjustable thickness mechanism.

FIG. 55 is a disengaged side elevational view of FIG. 54.

FIG. 56 is a side elevational view of a clip holding a first thickness of sheet material with one size of cam.

FIG. 57 is a side elevational view of a clip of FIG. 58 with a different size of cam being swung into position.

BEST MODE FOR CARRYING OUT THE INVENTION

Figure 1:
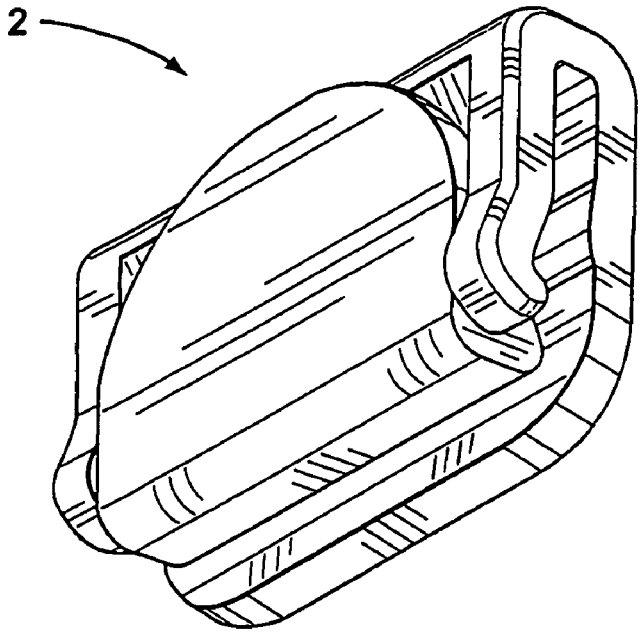
FIG. 1 is a perspective view of one embodiment of the paper clip in a closed position.

In the description which follows, like parts are marked throughout the specification and the drawings with the same respective reference numerals. The drawings are not necessarily to scale and in some instances proportions may have been exaggerated in order to more clearly depict certain features of the invention.

FIGS. 1, 1*a*, 2 and 3 illustrate one embodiment of the invention which comprises a clip 2 for securing sheet material 40 together. In particular the paper clip 2 has opposed first 4 and second 6 spaced surfaces. The first surface 4 has a forward edge 8 and a rear edge 10 while the second opposed surface 6 also has a forward edge 12 and a rear edge 14. The rear edges 10 and 14 of first and second opposed surfaces 4 and 6 respectively are connected together by a connecting member 16 so as to permit insertion of sheet material such as paper 40 through the forward edges 8 and 12 between the first and second surfaces 4 and 6 respectively.

Figure 2:
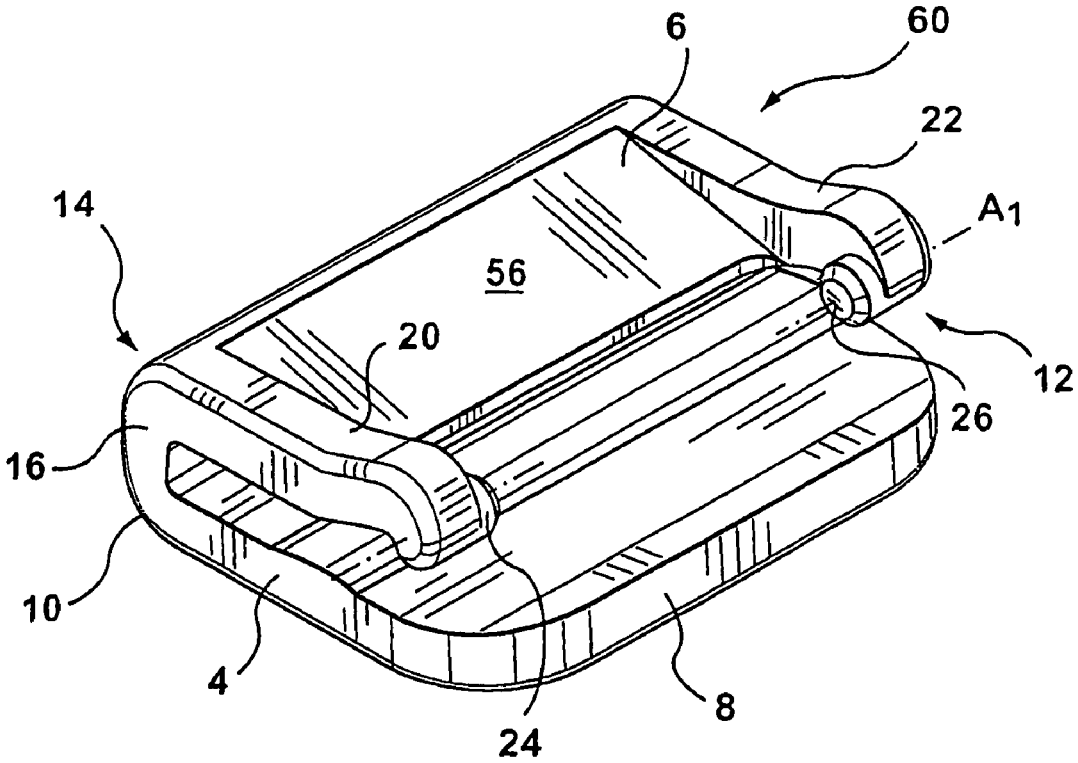
FIG. 2 is a perspective view of the base or housing.

The first opposed surface 4 also defines a base which extends upwardly through the connecting member 16 and merge with the second surface 6. The second surface 6 includes spaced arms 20 and 22. In particular the spaced arms 20 and 22 are carried by the second surface 6 as best illustrated in FIG. 2. In this way the base 6 extends upwardly to present two spaced apart arms 20 and 22.

The first surface or base 4 is substantially flat as shown.

The spaced arms 20 and 22 each present posts 24 and 26 which are axially aligned along axis $A_1$ and extend for a short distance between the arms 20 and 22.

The second surface 6 includes a cam member 30.

Figure 3:
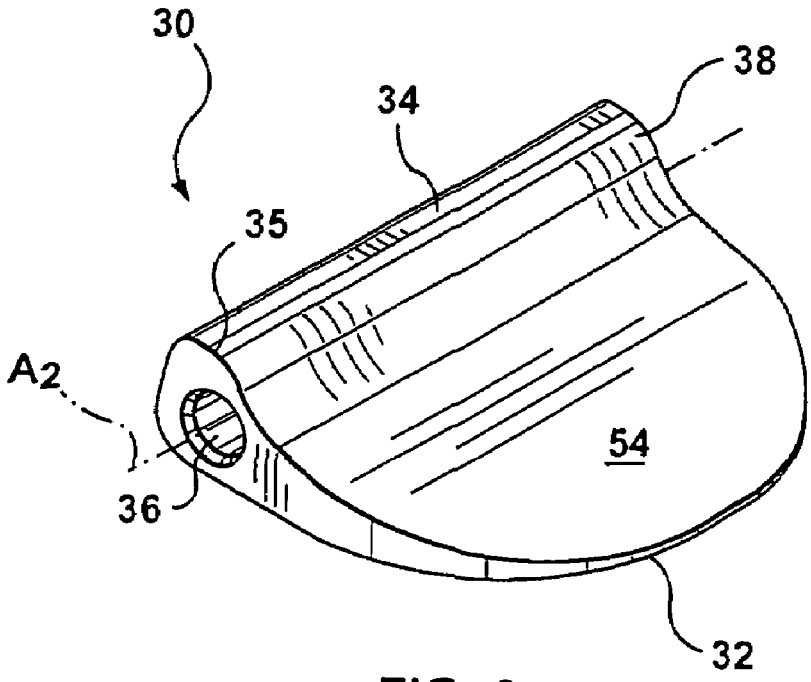
FIG. 3 is a perspective view of the cam member.

The cam member 30 is generally illustrated in FIG. 3 and consists at one end thereof a tab member 32 which is operably movable as described herein and furthermore the cam member 30 also includes a cam portion 34 which comprises of an enlarged portion at another end of the cam member 30 as best illustrated in FIG. 3. The enlarged or cam portion 34 also includes two opposed holes 36 and 38 which are axially aligned along axis $A_2$ and adapted to receive the posts 24 and 26 respectively.

The paper clip 2 can be comprised of a variety of materials and in one embodiment consists of suitable plastic which will permit the arms 20 and 22 to flexibly spread apart to accommodate the insertion of the cam member 30 between the arms 20 and 22 and the registration of the posts 24 and 26 within the holes 36 and 38 respectively; for rotational displacement or movement of the cam member 30 relative arms 20 and 22. Alternatively the clip can be comprised of metal.

As can be seen from FIGS. 2 and 3 the posts 24 and 26 are suitably chamfered as well as the holes 36 and 38 to permit the easy insertion of the cam member 30 so that the axis $A_1$ of the posts 24 and 26 co-axially align with the axis $A_2$ of holes 36 and 38.

Figure 1A:
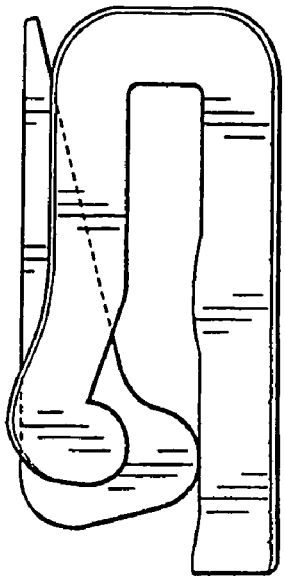
FIG. 1*a* is a side elevational view of FIG. 1.
Figure 4:
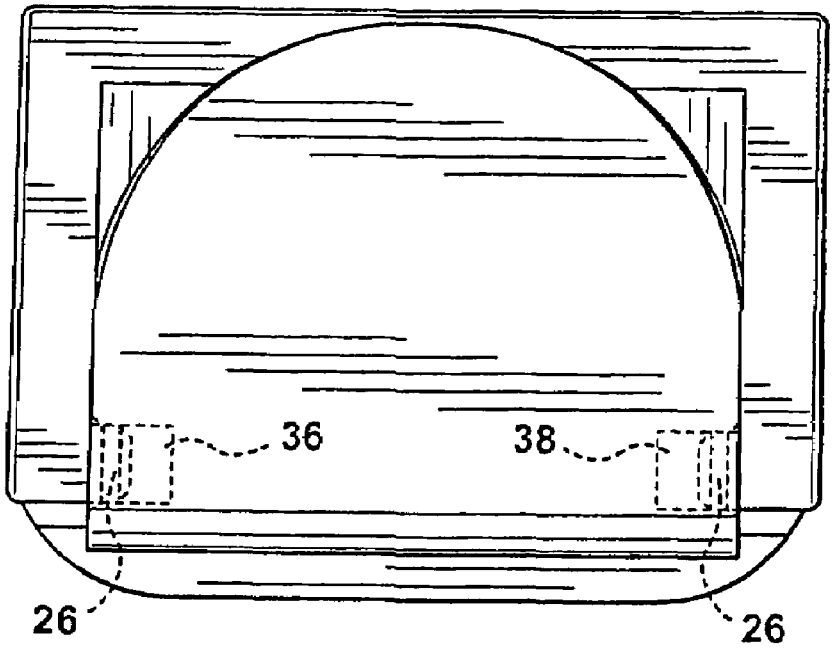
FIG. 4 is a top plan view of the paper clip in a closed position.

FIG. 4 is a top plan view of the paper clip 2 in a closed position showing the assembly of the cam member 30 relative the arms 20 and 22. In particular one can see the insertion of the posts 24 and 26 within the holes 36 and 38 respectively. Moreover FIG. 1*a* illustrates that in the closed position the cam portion 34 contacts the base 4 so as to exert the optimum force there between and grip the paper. In other words there is no gap. However the benefits of the invention may still be realized if there was a space or gap between the cam portion 34 and base 4 in the closed position particularly if one desired to clip a large stack of paper.

Figure 5:
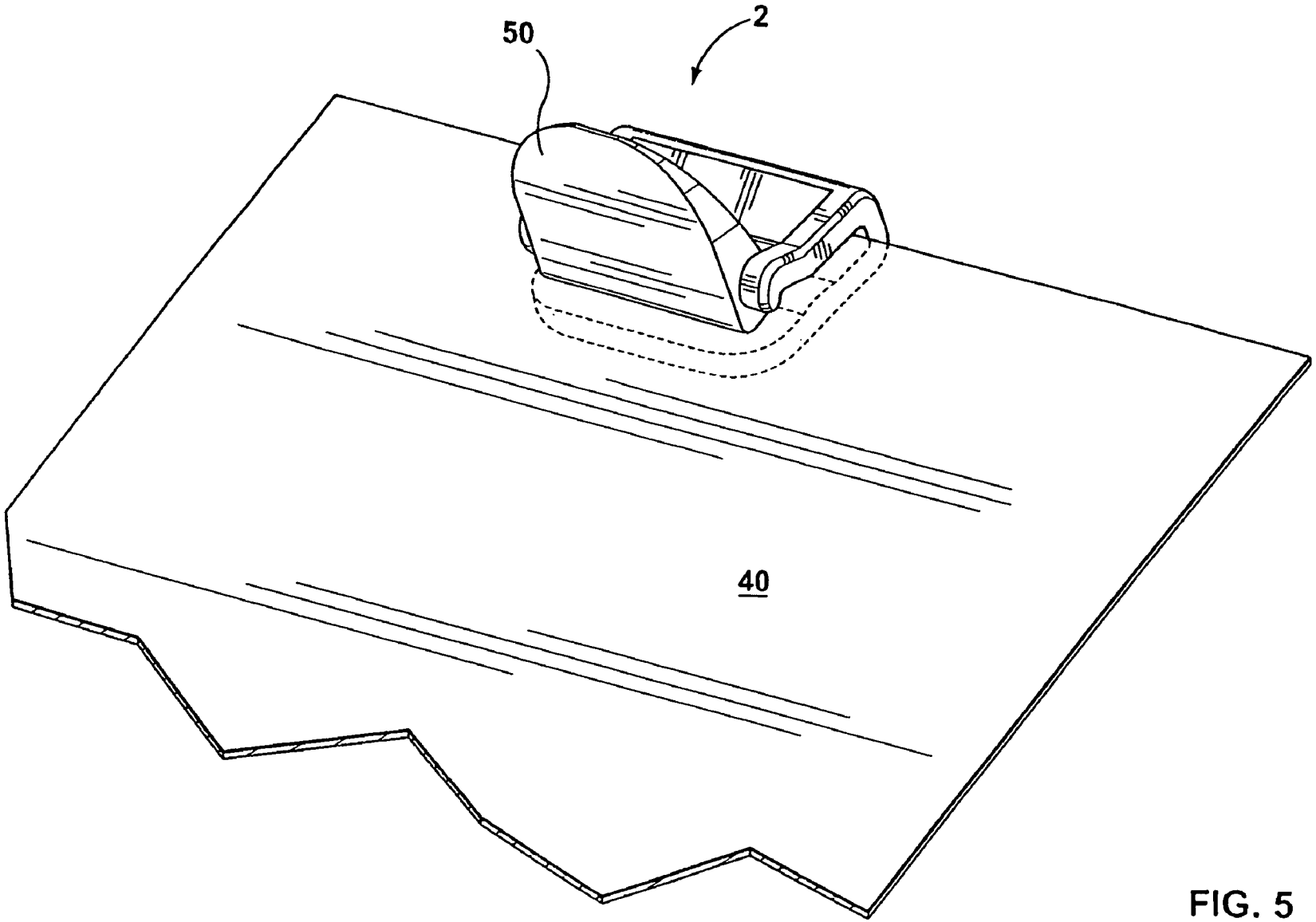
FIG. 5 is a perspective view of one embodiment of the paper clip in an open position.
Figure 6:
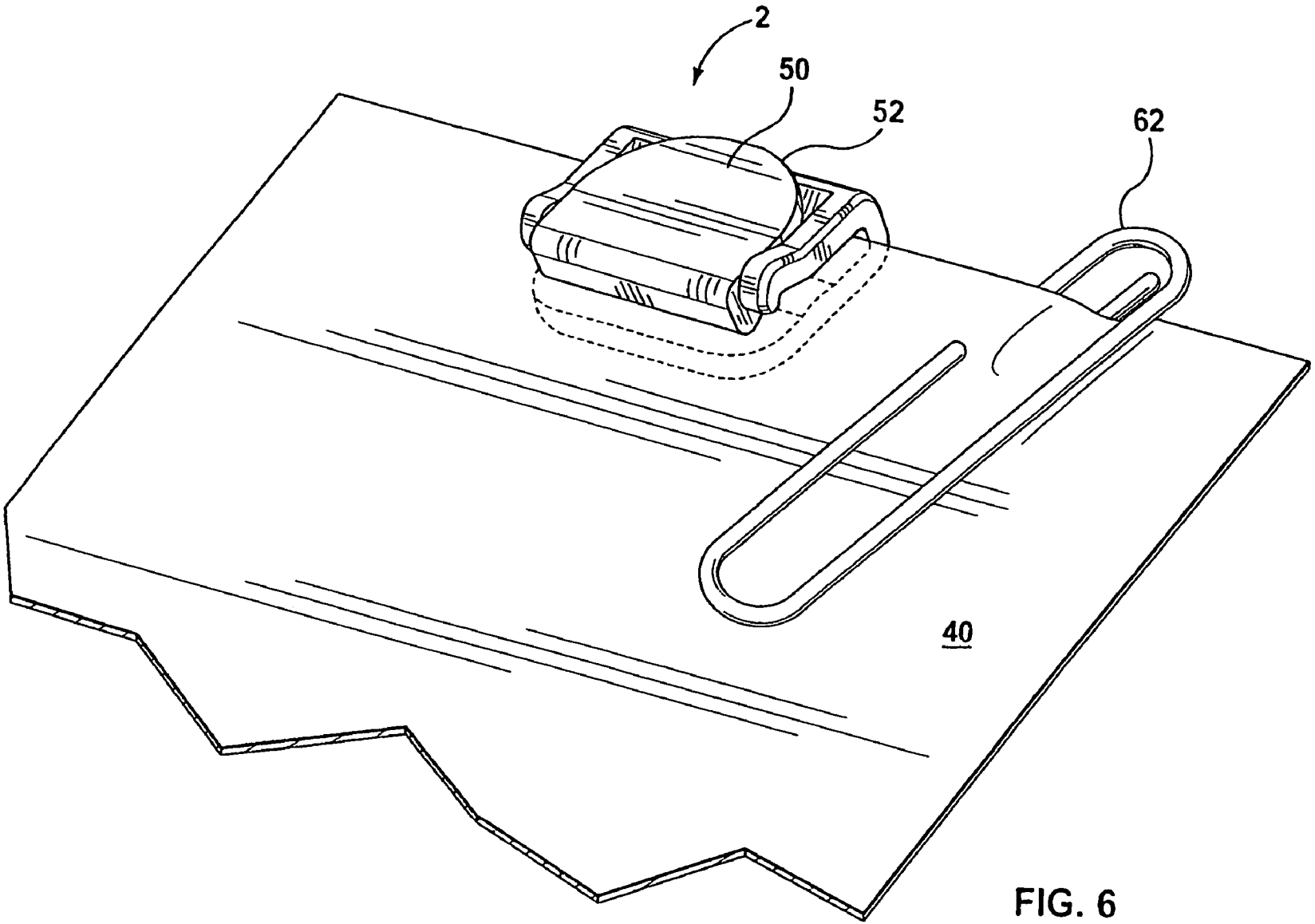
FIG. 6 is a perspective view of a paper clip in a closed position.
Figure 7:
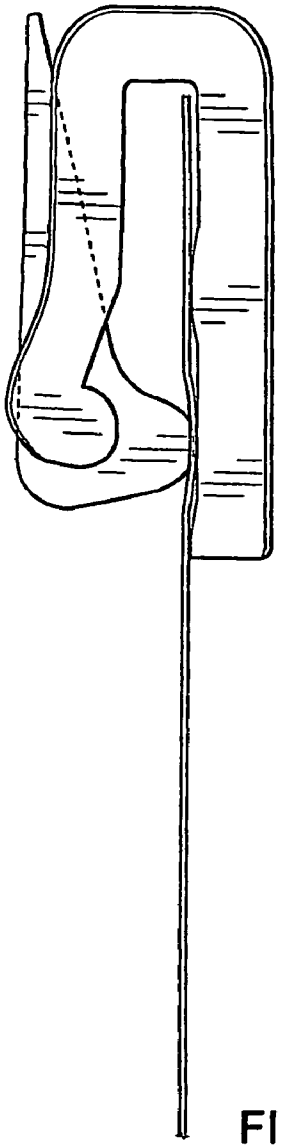
FIG. 7 is a side elevational view of the paper clip in a closed position.

The tab member 30 is adapted for displaceable movement about axis A (which comprises the co-axial superimposition of $A_1$ and $A_2$) relative the base 4 as well as the first and second opposed surfaces 4 and 6 from an open position as shown in FIG. 5 to a closed position as shown in FIGS. 6 and 7.

Figure 8:
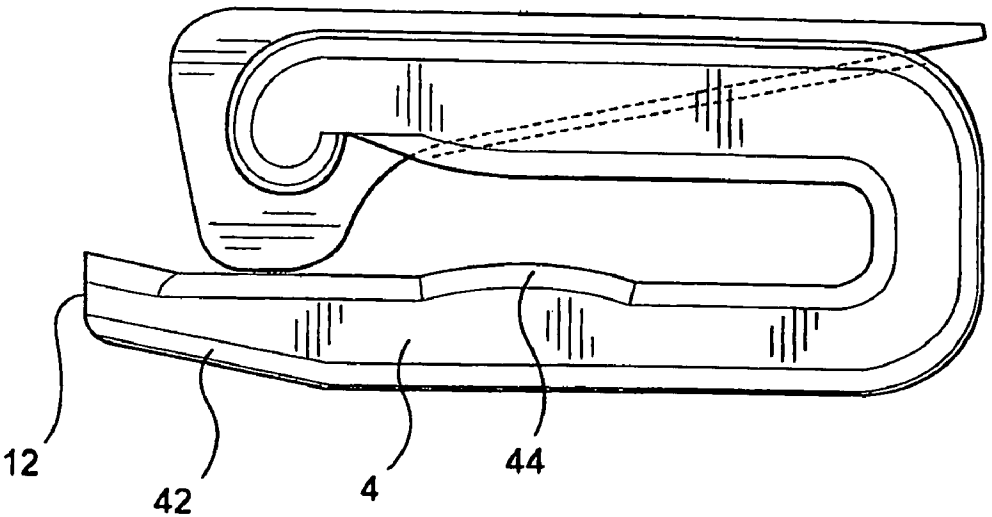
FIG. 8 is a detailed side view of one embodiment of the paper clip.

As can be seen from a detailed side elevational view of FIG. 8 the base or first surface 4 includes an upturned forward edge 12 for inhibiting the accidental insertion of paper 40 once the paper clip is in its closed position. The upturned forward edge 12 blocks entry of paper into the cavity defined by first and second surfaces and connecting member 16, when the paper clip 2 is in the closed position.

Furthermore the bottom surface 42 of the upturned front edge 12 of the first surface 4 defines an angled surface for diverting paper 40 away from the clip 2.

The lower surface or base 4 includes a raised portion 44 between the forward edge 8 and rear edge 10 of the base 4 to bend the paper 40 within the cavity so as to assist trapping the paper 40 in the closed position.

A tab member 32 presents a first or top surface 50 as shown in FIG. 6 which may be substantially flat so as to permit the placement of indicia such as the instruction on the use of the paper clip or other advertising material such as a company logo or the like. The tab 32 may be suitably dimensioned as shown in FIG. 6 so as to present a curved edge 52 which extends slightly beyond the rear edge 14 of second surface 6 so as to easily permit a user to push or pull the tab 32 from the closed position shown in FIG. 6 to the open position shown in FIG. 5.

Moreover the lower surface 54 of the tab 32 may be shaped or sculpted to present a gradually diminishing thickness from the holes 36 to the edge 52 so that the tab 32 may be nestled into an appropriately shaped recess 56 presented by the top surface of the second opposing surface 6 to accommodate the reception of the tab 32 in the closed position, so as to present a compact configuration.

The cam member 30 includes an enlarged cam portion 34 which presents a desired side profile 35 to permit the cam surface 34 to be pushed into contact with the paper 40 inserted between the surfaces 4 and 6 in a closed position; as well as permitting a cam surface 34 to be moved away or displaced away from the first surface 4 to permit insertion of the paper between the first and second surfaces 4 and 6; or alternatively to permit a user to withdraw paper 40 placed between the first and second surfaces 4 and 6 respectively.

The spaced opposed surfaces 4 and 6 generally define a housing or frame structure 60 which is operably connected to the displaceable cam member 30.

The paper clip 2 can be suitably dimensioned so as to minimize the intrusion of the paper clip 2 over the paper when compared to prior art paper clips 62 as shown in FIG. 6.

Figure 10:
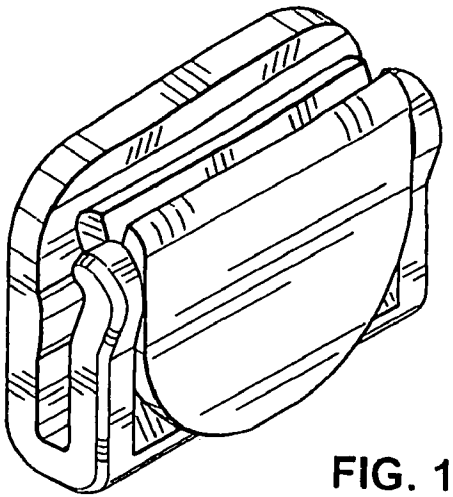
FIG. 10 is a perspective view of the second embodiment of the invention in a closed position.
Figure 11:
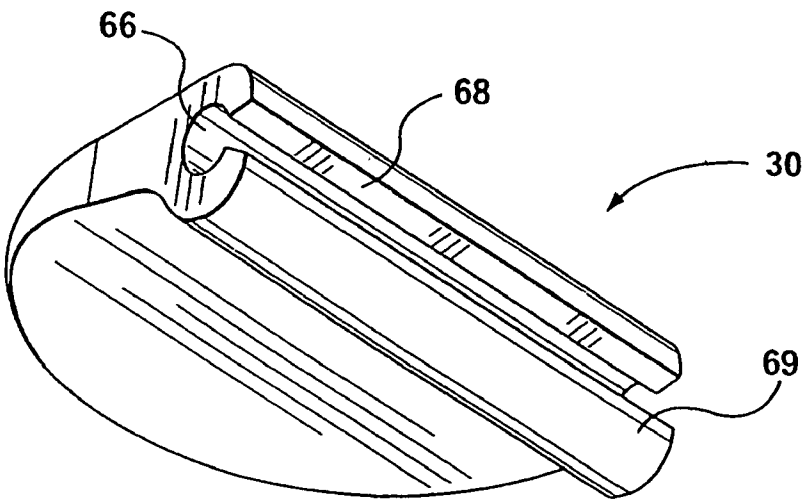
FIG. 11 is a perspective view of the cam member of FIG. 10.
Figure 9:
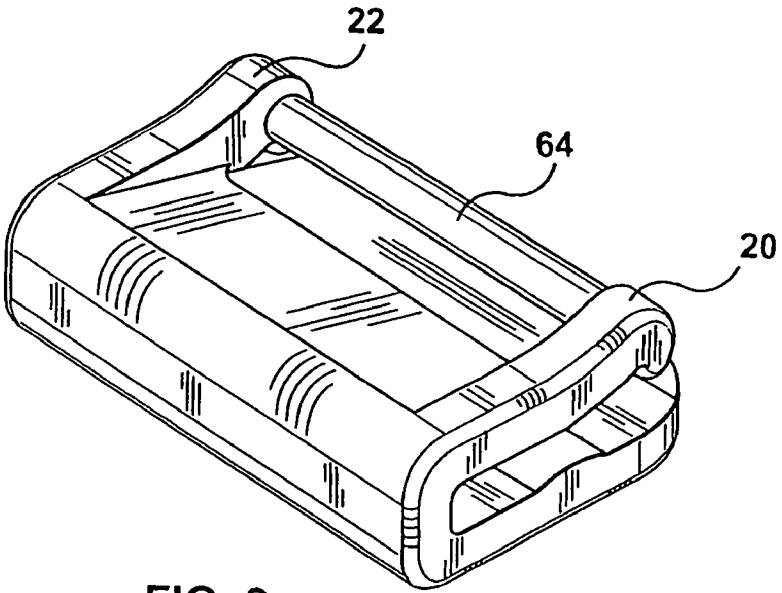
FIG. 9 is a perspective view of another embodiment of the invention illustrating a rod between the arms of the paper clip.

FIGS. 9, 10 and 11 illustrate another embodiment of the invention which includes a rod 64 which extends from and between the arms 20 and 22. The cam member 30 includes a slot 66 which is adapted to accommodate and receive the rod 64 to permit pivotal movement of the cam member 30 about the rod 64. The slot 66 is dimensioned to receive the rod 64. As previously mentioned the cam member 30 can comprise of flexible material such as plastic whereby the edges 68 and 69 of the slot 66 deform and accommodate the insertion of the rod 64. The assembled view of a second embodiment of the invention is shown in FIG. 10.

FIGS. 12-17 inclusive illustrate a third embodiment of the invention which also comprises a base 6 and cam member 30.

Figure 12:
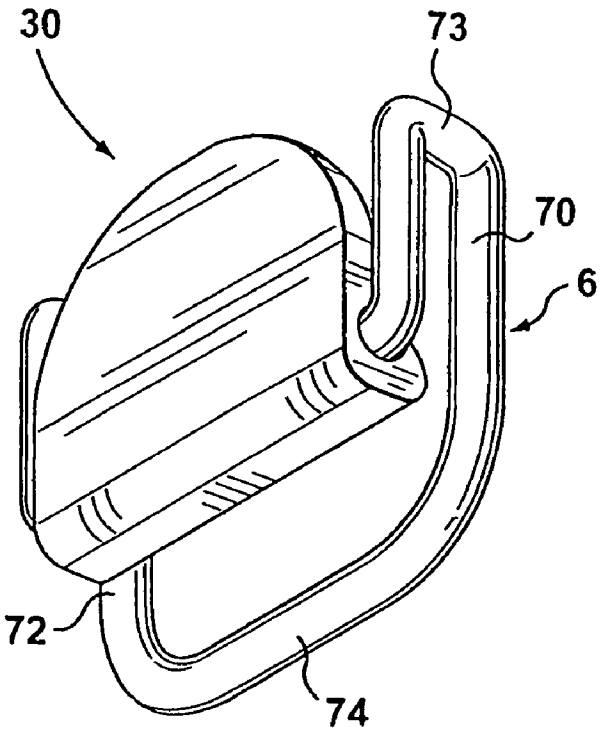
FIG. 12 is a perspective view of a third embodiment of the invention in a closed position.
Figure 15:
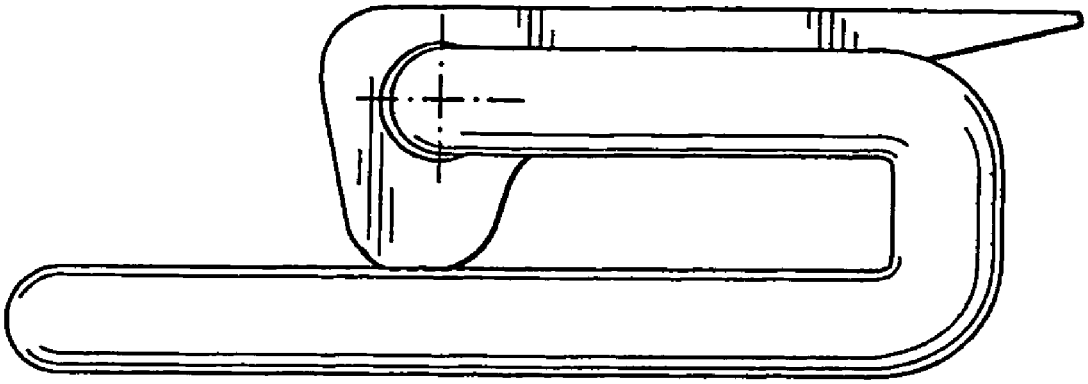
FIG. 15 is a side elevational view of FIG. 12 in a closed position.
Figure 16:
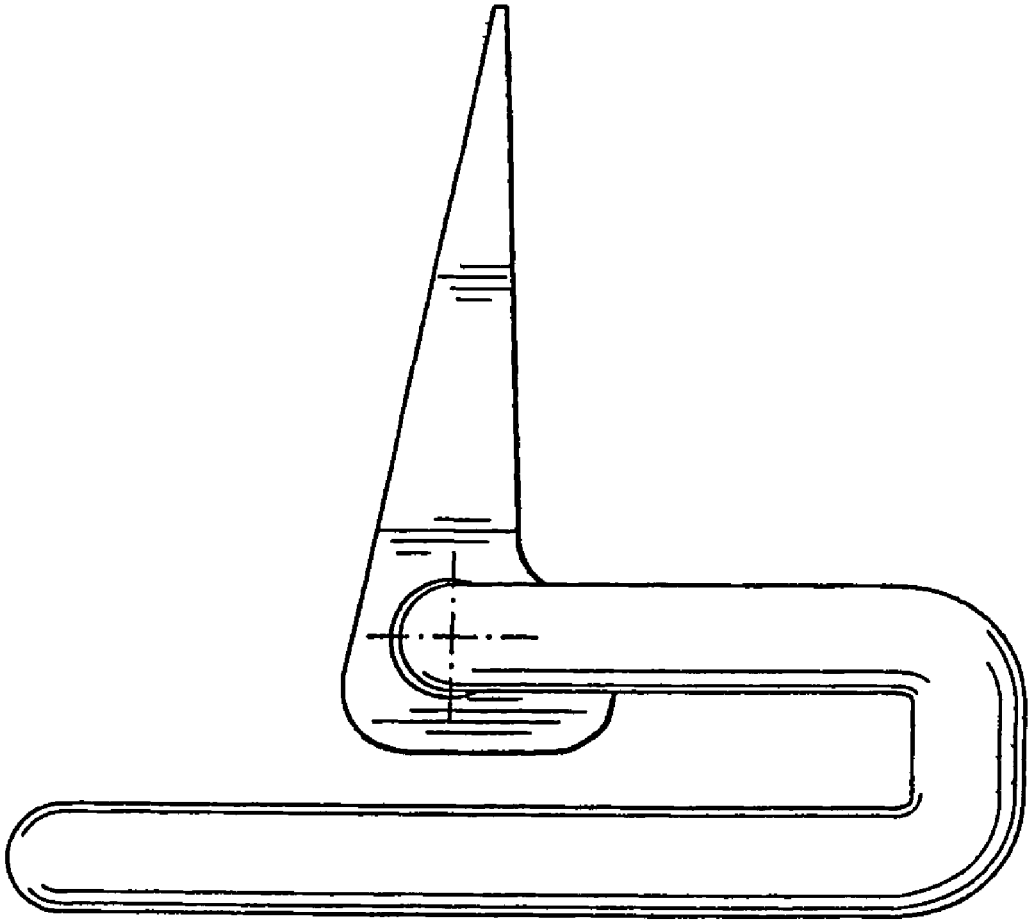
FIG. 16 is a side elevational view of FIG. 12 in an open position.
Figure 17:
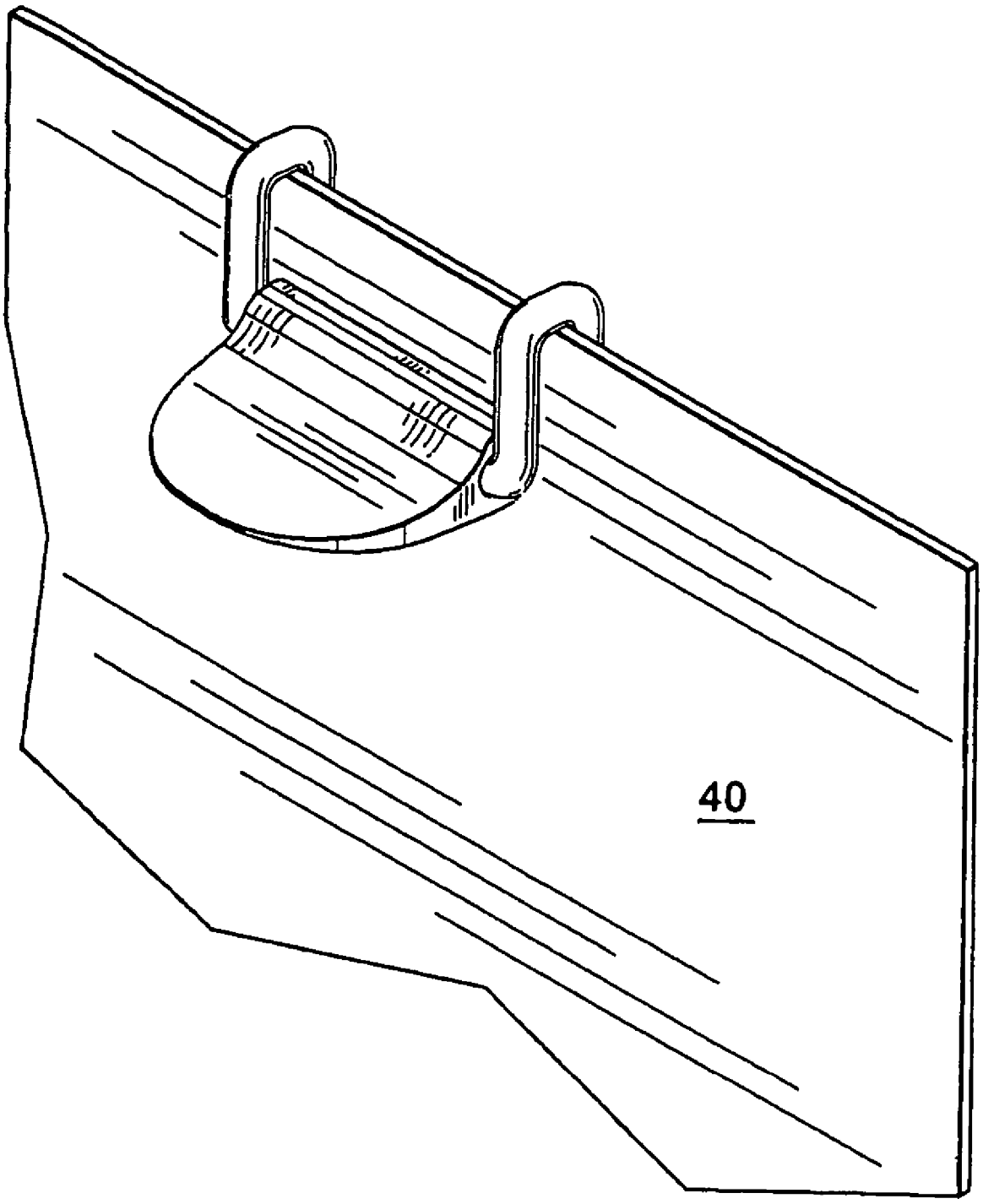
FIG. 17 is a perspective view of the embodiment shown in FIG. 12 with the paper inserted therein.

The base 6 comprises two spaced leg member 70 and 72 joined together by a connecting member 74. Each leg member 70 and 72 presents an arm member 22 and 24 respectively as shown in FIGS. 11 and 12. The arm members 22 and 24 are spaced from the leg members 70 and 72 respectively by a spacing member 73. Each of the leg members 70, 72, connecting member 74, arms 22 and 24 and spacing member 73 are circular in cross-section. The arm members 22 and 24 are presented by the leg members 72 and 70 in the region remote-from the connecting member 74. The-end 75 of the arm members 22 and 24 are turned inwardly and are adapted to be received by the holes 36 and 38 of the cam member 30.

The embodiment shown in FIGS. 12-17 can comprise of any suitable material such as plastic or the like or alternatively the legs 70 and 72, connecting member 74, spacing member 73 and arms 22 and 24 can be made from wire or metal which is easily bent. The arms 22 and 24 may be bent away from one another so as to place the cam member 30 therebetween for registration of the ends 75 with the holes 36 and 38 of the cam member 30.

Figure 14:
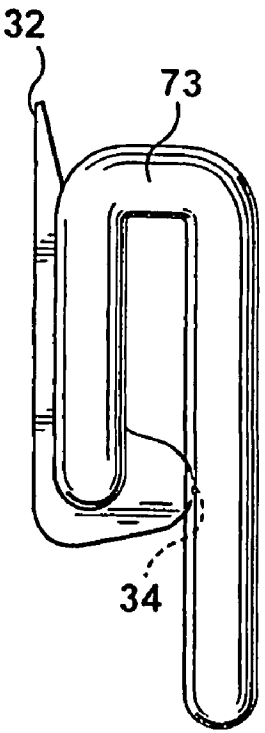
FIG. 14 is a side elevational view of FIG. 12.
Figure 13:
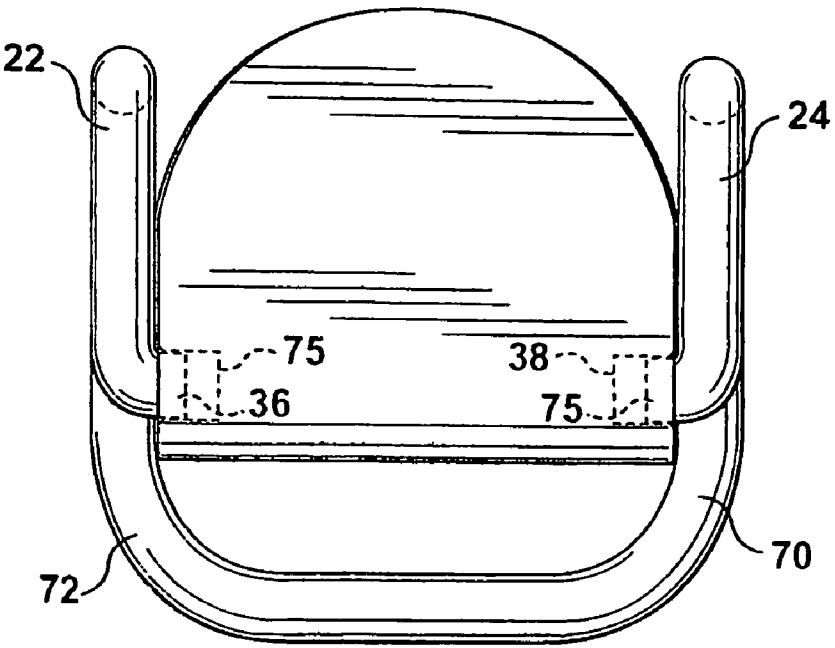
FIG. 13 is a top plan view of FIG. 12.

The cam member 30 can be dimensioned so as to present a cammed surface 34 which extends slightly beyond the legs 70 and 72 in the closed position as best seen in FIG. 14 so as to assist in the clamping action of the paper inserted between the arms 22 and 24 and legs 70 and 72.

FIG. 14 shows that the arms 22 and 24 and legs 70 and 72 are substantially parallel although it is also possible to have the ends 75 of the arms 22 and 24 tapered slightly inwardly towards the legs 70 and 72 in the vicinity away from connecting member 73 so as to assist in the "pinching" or "gripping" action of the cam surface 34 relative the legs 70 and 72.

Figure 19:
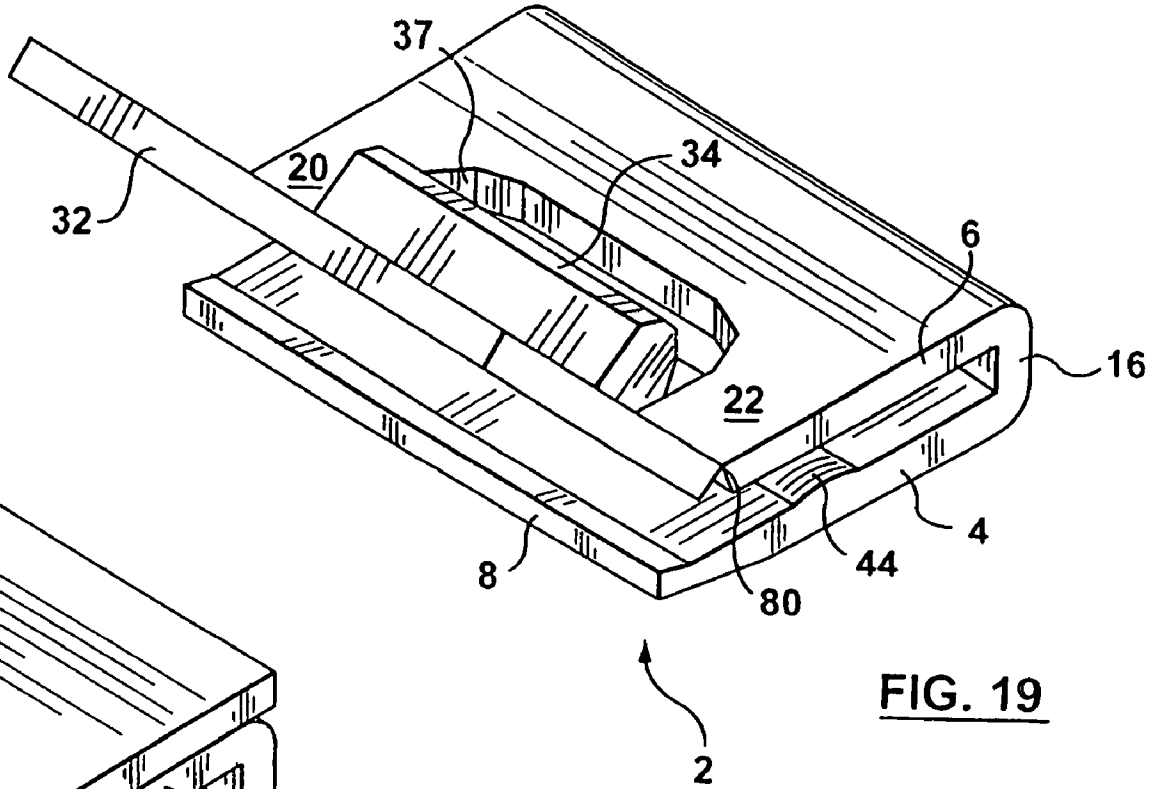
FIG. 19 is a perspective view of the embodiment illustrated in FIG. 18 in an open position.
Figure 18:
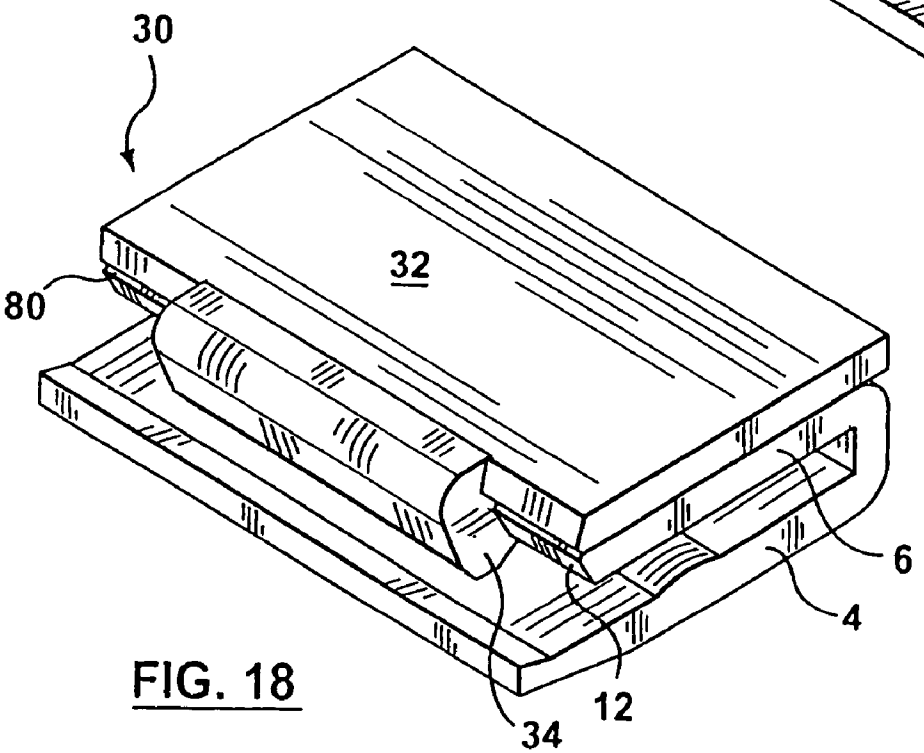
FIG. 18 is a perspective view of another embodiment of the invention in a closed position.
Figure 20:
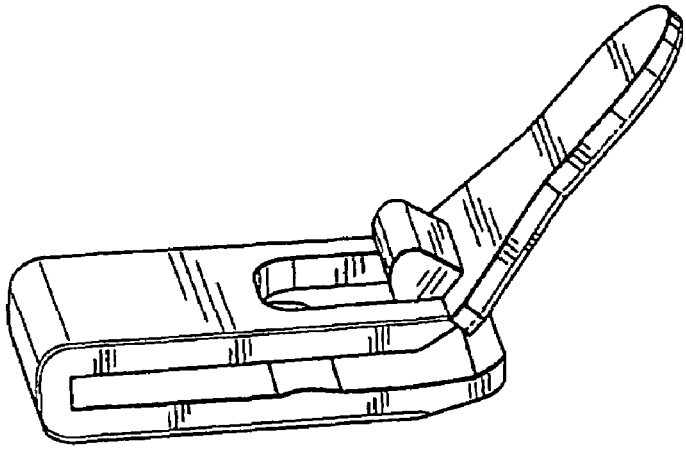
FIG. 20 is another perspective view of the embodiment shown in FIG. 19.

Another embodiment of the invention is illustrated in FIGS. 18, 19 and 20 which illustrates a one-piece paper clip 2. By way of example a suitable material for the paper clip comprises plastic. In particular the cam member 30 is integrally connected to the front edge 12 of the second member 6 by a reduction 80 in the thickness of the plastic material between the front edge 12 of the upper surface 6 and the cam member 30. The reduction 80 defines a web which permits the rotational movement of the cam member 30 from the closed position shown in FIG. 18 about the web 80 to the open position shown in FIG. 19.

The paper clip 2 can be extruded or molded in an appropriate machine. Since the plastic will tend to have a memory of the part in an open position the cam surface 34 can be suitably dimensioned relative the base 4 so as permit closure of the paper clip 30 to the closed position.

As can be best seen from FIG. 18 the second surface 6 can include a hole 37 to receive the cam 34 as the cam member 30 is swung from the closed position to the open position as shown.

The one-piece clip 2 is easy to manufacture and eliminates the need to assemble the cam member 30 to the arms 20 and 22.

Figure 21:
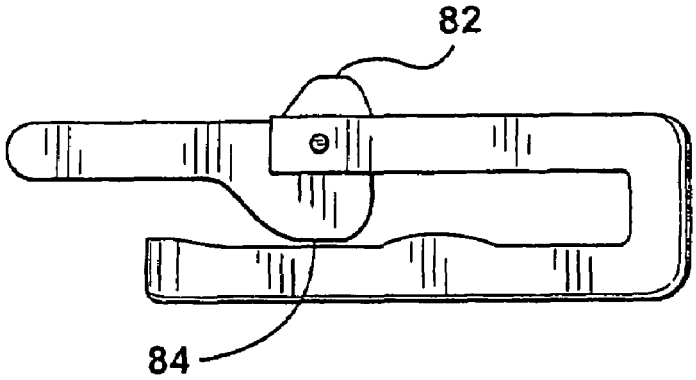
FIG. 21 is a side elevational view showing a first cam surface.
Figure 22:
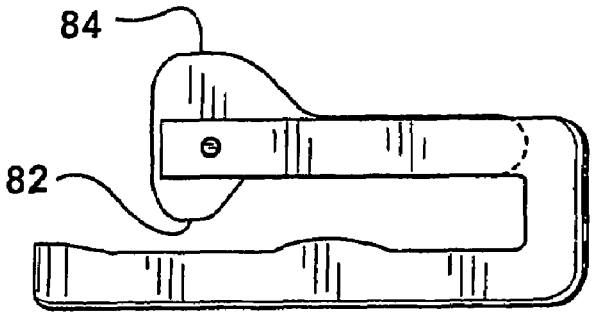
FIG. 22 is a side elevational view showing a second cam surface.

Another embodiment of the invention is shown in FIGS. 21 and 22 which illustrates that the cam member 30 can include a first cam surface 82 at one end thereof operably movable to a first closed position to close a first thickness of the paper 40 to clamp the first thickness of the paper 40 between the first cam surface 82 and the first surface or base 6. Furthermore the cam member 30 can also include a second cam surface 84 pivotally movable to a second closed position to clamp a second thickness of paper between the second cam surface 84 and the first surface or base 6. This way one paper clip 2 can accommodate two different thicknesses of stacked paper to be clipped therebetween.

Accordingly the paper clip 2 described herein can be used for clamping paper by:

(1) moving the tab 32 to a first opened position where the cam surface 34 is displaced away from the fist surface or base 6;

(2) inserting the paper through the forward edges 8 and 12 between the opposed surfaces 4 and 6;

(3) moving the tab 32 to a closed position where the cam surface 34 is displaced or rotated toward the second or base surface 6 to clamp the paper 40 between the cam surface 34 and the first surface or base 6.

Figure 25:
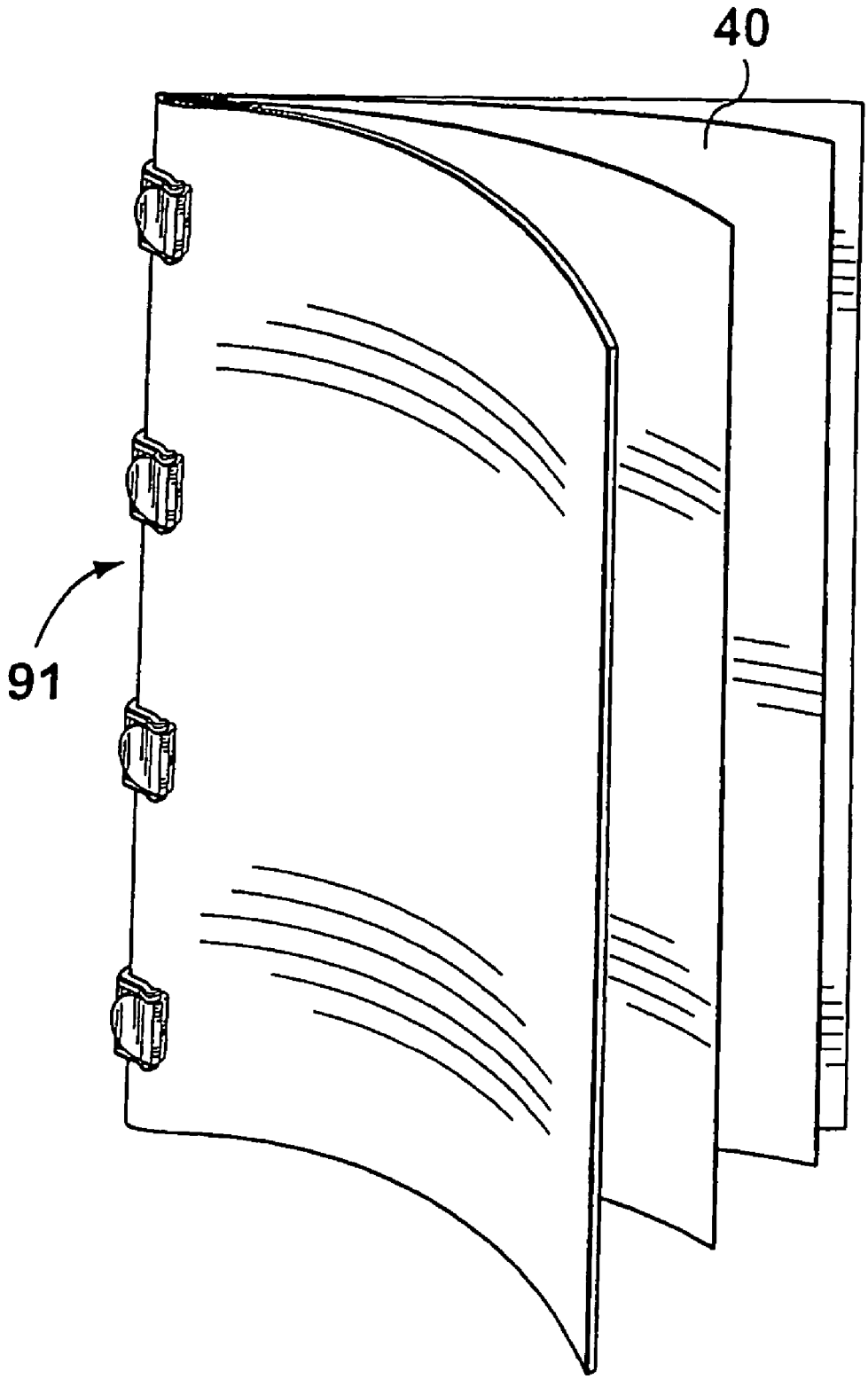
FIG. 25 is a top plan view showing the use of the invention as a binding system.

Furthermore as shown in FIG. 25 a plurality of paper clips 2 can be clipped along one edge 91 of the paper 40 to permit the paper to be separately moved about the one edge 91 of the paper much like a book since the paper clip 2 will not intrude significantly into the text of the paper. Alternatively the clip 2 can be combined or connected as shown so as to present a paper binder.

Figure 23:
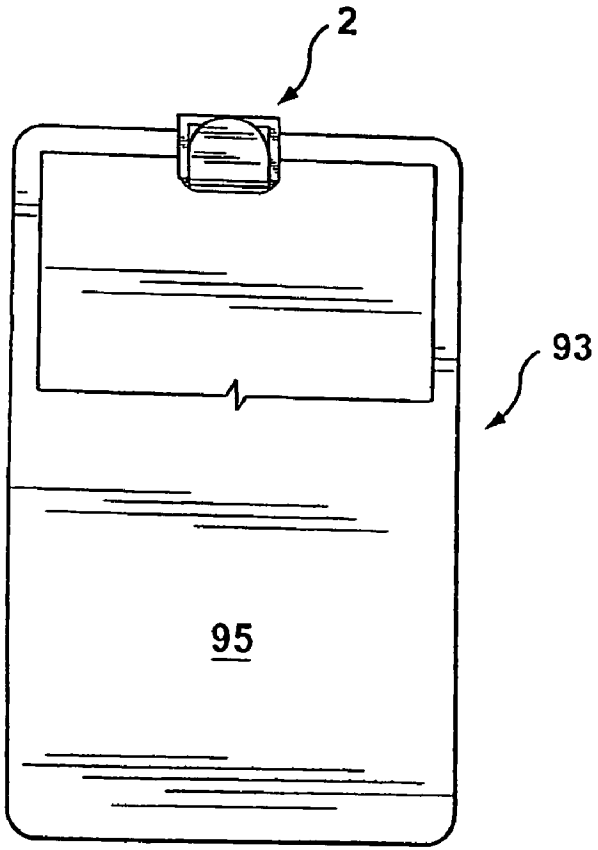
FIG. 23 is a top plan view illustrating the use of the invention as a clip board.

Moreover FIG. 23 illustrates that a clipboard 93 can be fashioned with the clip 2 secured to a board 95 to define a clipboard 93. Either one or more clips 2 may be secured near the top of the board 95.

Figure 24B:
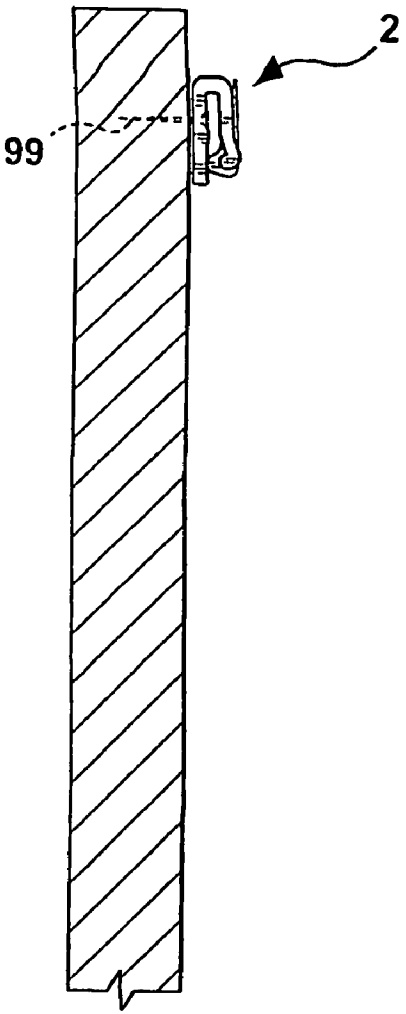
FIG. 24*b* is a side elevational view where the base includes a pin for use of the device as a pin holder.
Figure 24A:
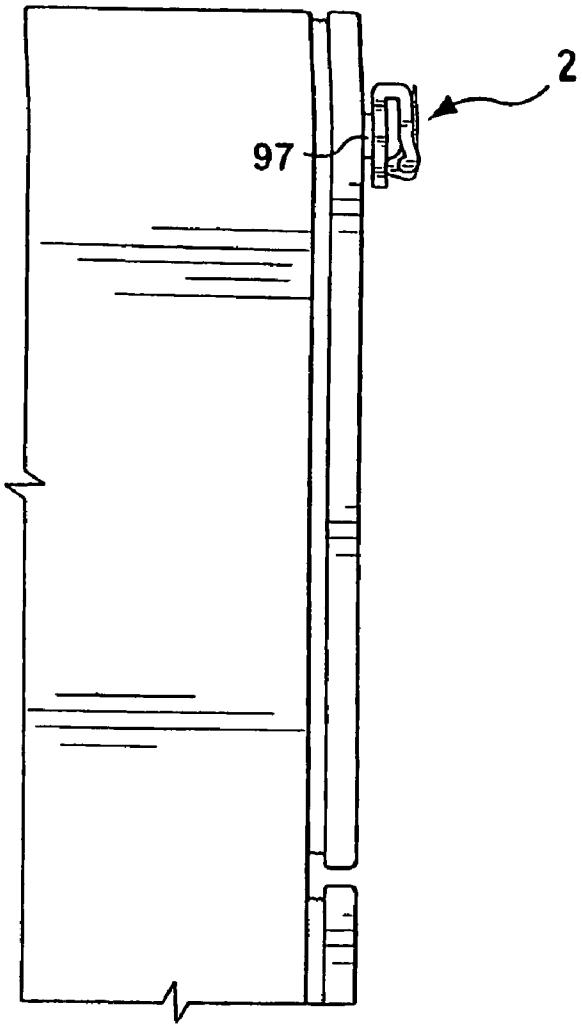
FIG. 24*a* is a side elevational view showing that the base 4 is comprised of magnetic material for use as a fridge magnet capable of clipping sheets of material.

FIG. 24*a* shows the base 4 having a magnetic material 97 for use as a fridge magnet and FIG. 24*b* shows the pin type paper clip 2 having a base 4 presenting a pin 99 where the paper clip holds paper that can be pinned to a message board.

Figure 26:
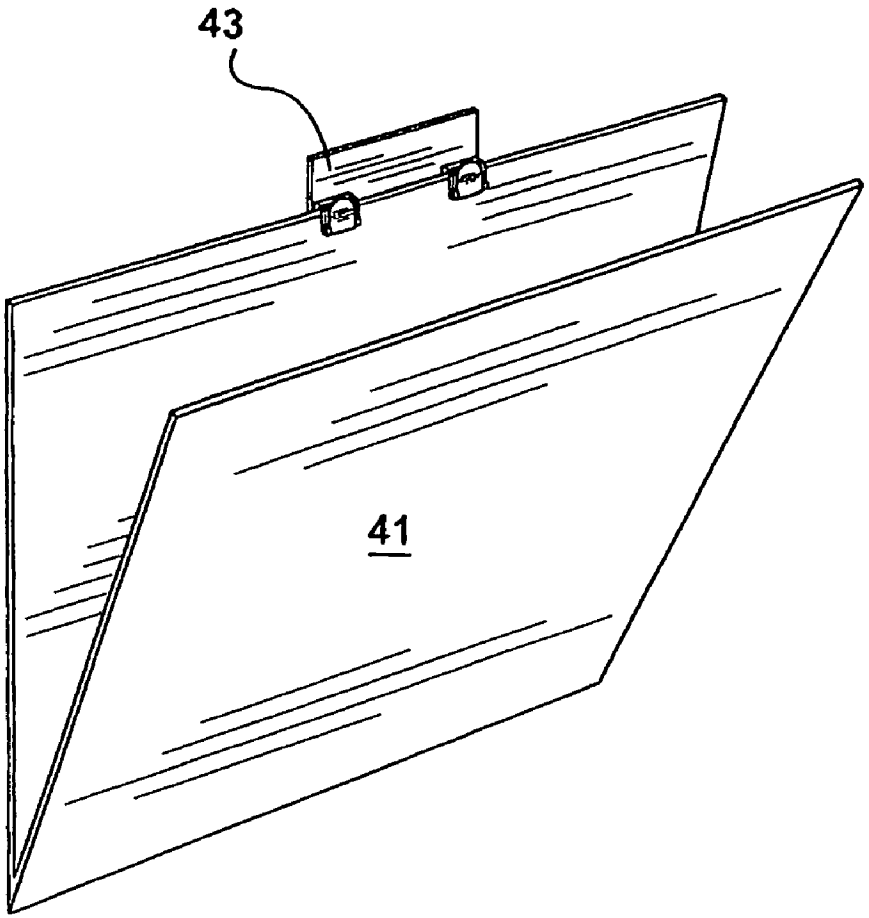
FIG. 26 is a top plan view showing the use of the invention as a tab for a file folder.

FIG. 26 illustrates another embodiment of the invention where the base 4 includes a extension or file tab 43. The clip 2 can be attached to an office file and act as a marker. Two small spaced clips are shown in FIG. 26. The file tab 43 is adapted to receive indicia such as a sticky label to be written on, or alternatively the file tab can comprise a material to be written on. Once the office file is stored in a filing cabinet the file tab will stick out to mark its location.

Figure 27:
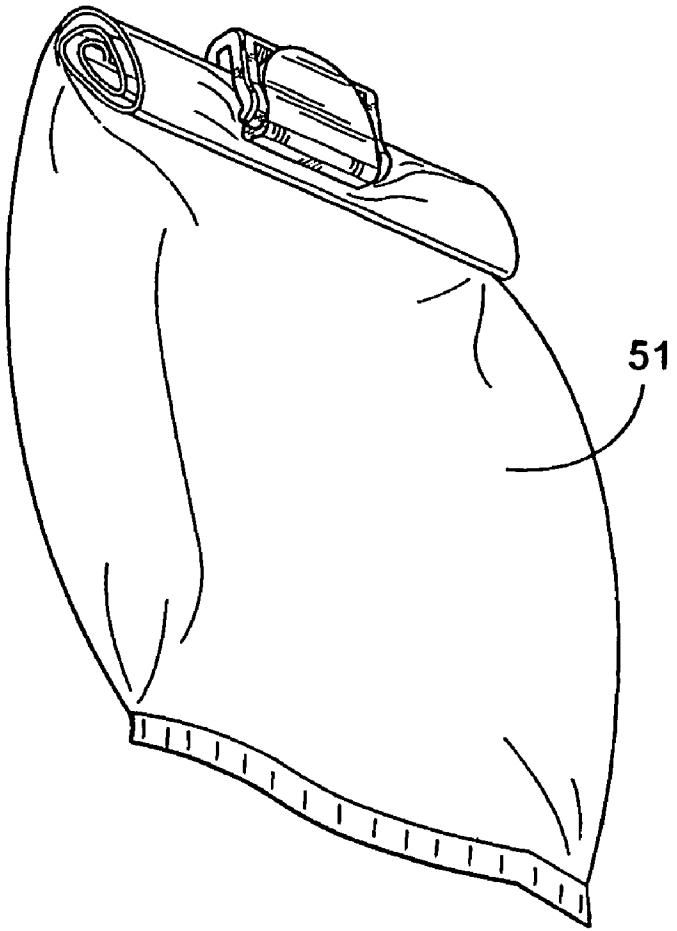
FIG. 27 is a perspective view showing the clamp being used to temporarily close an open bag.

FIG. 27 shows the use of the clip 2 in closing the open bag, such as a potato chip bag 51.

Figure 28:
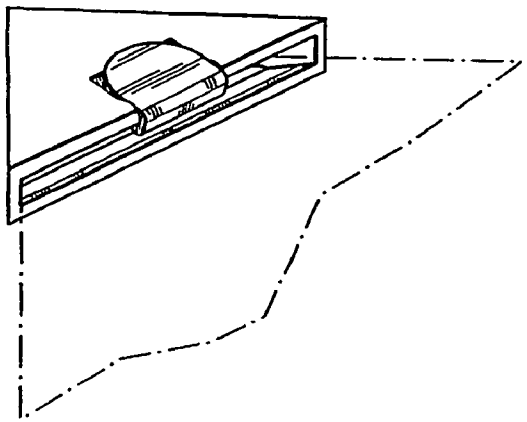
FIG. 28 is a perspective view of the clip adapted to clip the corner of a stack of paper.
Figures 31, 32:
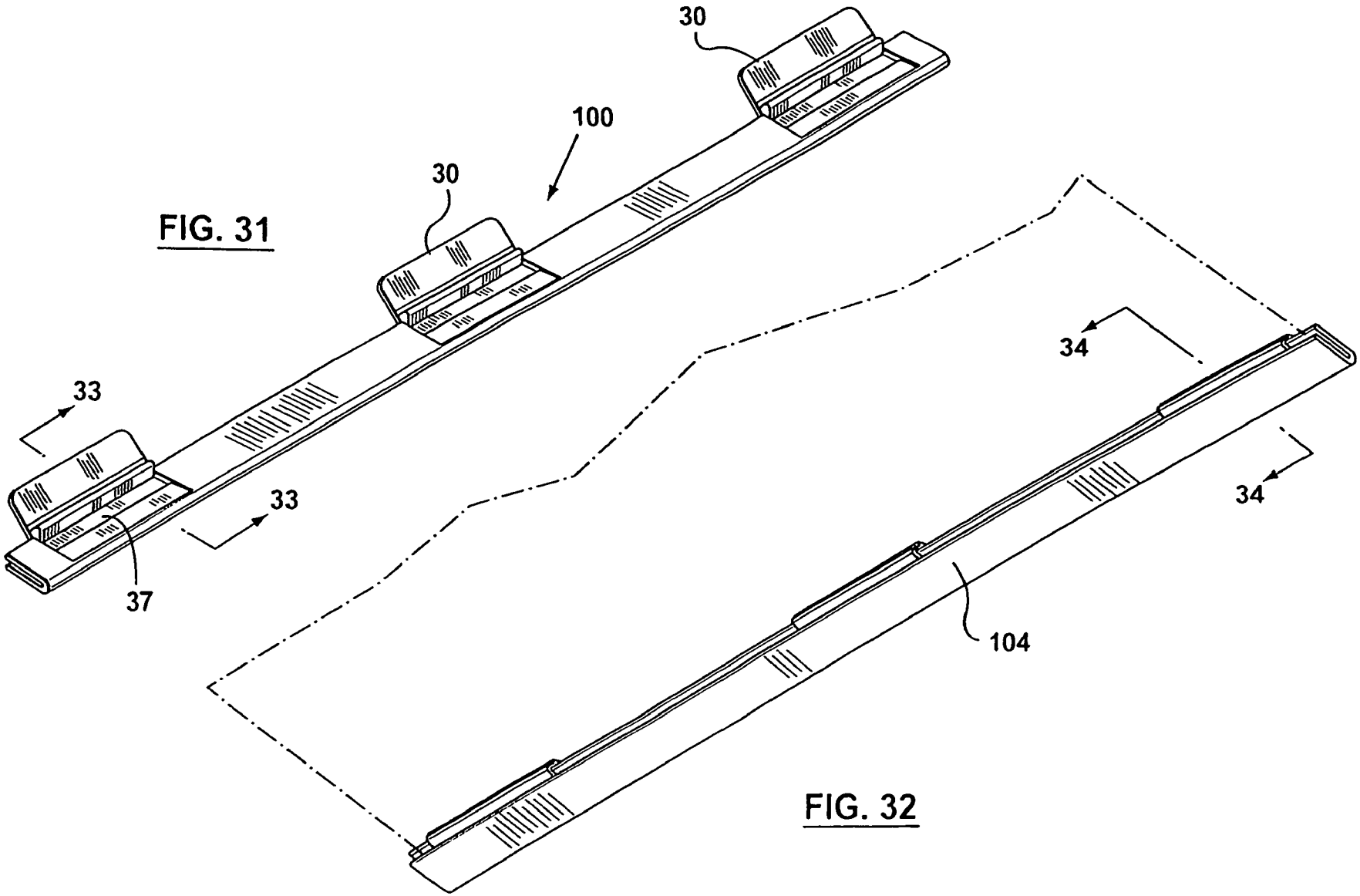
FIG. 31 is a top perspective view illustrating a paper binder.
FIG. 32 is a bottom perspective view of FIG. 31.
Figure 33:
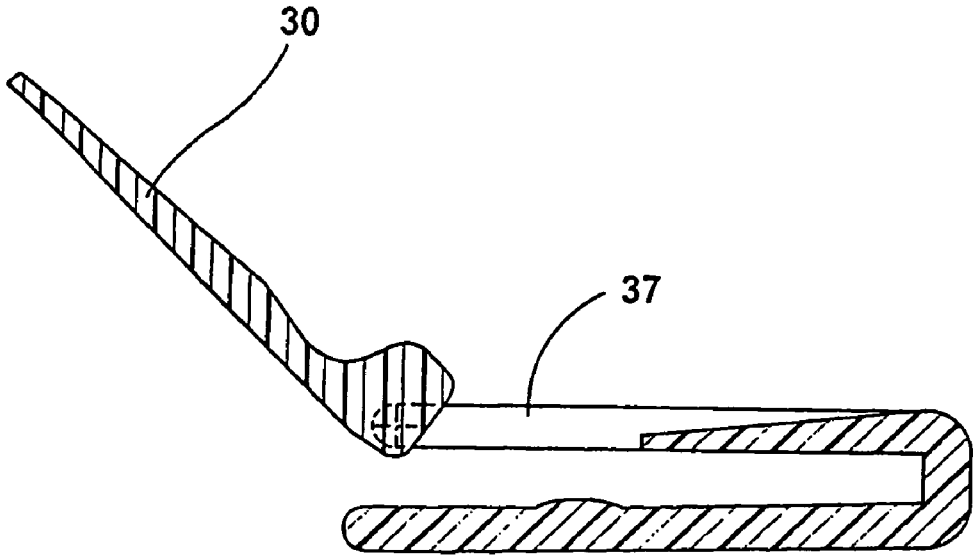
FIG. 33 is a cross sectional view taken along 34-34 of FIG. 32 in the closed position.
Figure 34:
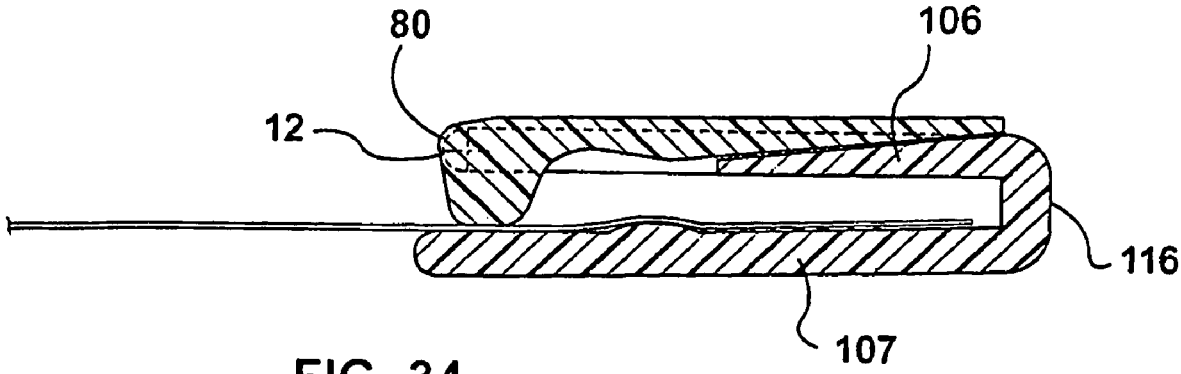
FIG. 34 is a cross sectional view taken along 34-34 of FIG. 32 in the closed position.

FIG. 28 illustrates the clip 2 adapted to clip the corner of a stack of paper.

Figure 29:
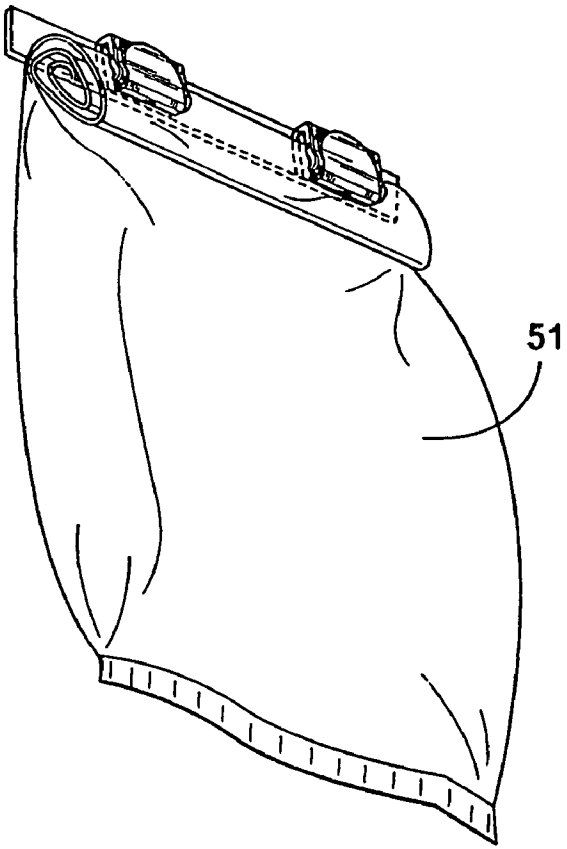
FIG. 29 is a perspective view of a plurality of clips carried by a frame to hold either one article or bag or a plurality of articles or bags respectively.

FIG. 29 illustrates a plurality of clips 2 carried by a frame to attach either one article thereto or a plurality of articles respectively.

Figure 30:
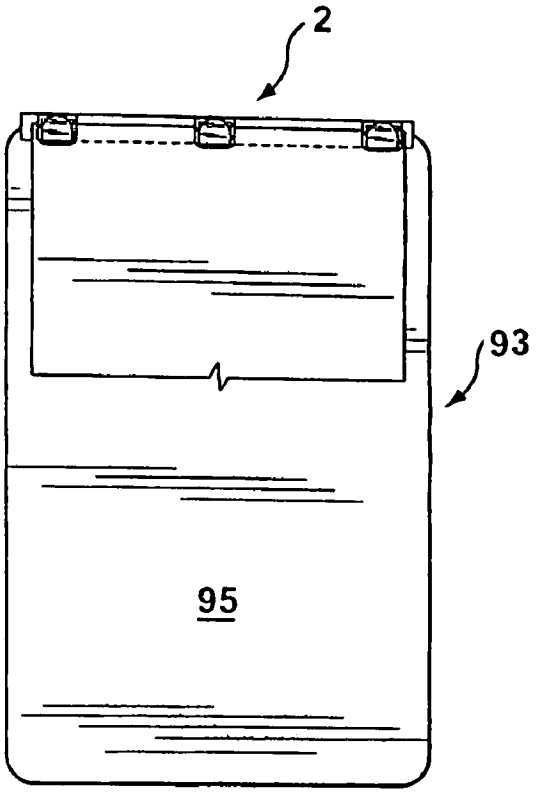
FIG. 30 is a top plan view showing the clip used as a clipboard.

FIG. 30 illustrates a clipboard which has the clip 2 described herein attached thereto to hold paper to the clipboard.

Another embodiment of the invention is illustrated in FIGS. 31 to 34 inclusive which consists of a plurality of clips 2 which define a paper binder 100 having a first opposed or base strip 104 which extends upwardly through the connecting extension 116 and merge with the second strip 106. Each cam member 30 is integrally connected to the front edge 12 of the second strip 106 by a reduction 80 which defines a web which permits the rotational movements of the cam members from the closed position shown in FIG. 34 to the open position shown in FIG. 33. The second strip has a plurality of holes 37 to receive the cams 30. Alternatively the cam members can be adapted to rotate about the pins as described above. The bookbinder is adapted to removably receive a stack of pages.

The paper clip described herein has the following perceived advantages:

(1) a higher perceived value than prior art paper clips that may be less likely to the thrown out with the papers;

(2) the camming action makes the paper clip 2 reusable many more times than a prior art paper clip whose spring action decreases with use. Such reusability may save cost in the long run as well as the time to reorder same;

(3) the paper clips described herein can include messages on the tab as herein described;

(4) moreover the paper clips having a better clamping or gripping force and can be used instead of staples;

(5) furthermore the paper clip described herein can be dimensioned so as to cover the corners of the paper to make them more attractive and appealable in a finished presentation;

(6) a larger version of the paper clip described can replace large metal paper clips that can scratch desks and boardroom tables;

(7) there is less likelihood of tangling up stray paper with the clipped papers;

(8) metal paper clips rust if left on documents and stored for long periods of time whereas plastic paper clips described herein will not;

(9) two-sided cam designs as described above replace different sized prior art paper clips;

(10) paper clips described herein can be used to present papers in a booklet format;

(11) even one paper clip as described herein makes flipping through and reading the pages easier than using a prior art wire-bent paper clip at the top of the pages;

(12) oblong metal paper clips are often twisted out of shape and used as projectiles propelled by elastic bands. The paper clip described herein is safer with less likelihood of causing the same damage if propelled.

Although some of the embodiments of the invention are described in relation to paper clips, the invention is not be limited thereby as the invention can be utilized as tabs, binders, clipboards and the like. Furthermore this invention relates to clips which can fasten, grip, hold or attach one element to another in addition to securing sheet material. Furthermore the invention is not limited to securing, clipping, fastening, gripping or attaching paper, it can be used in relation to any sheet material, whether comprised of wood, metal, plastic, fabric or other material.

Figure 35B:
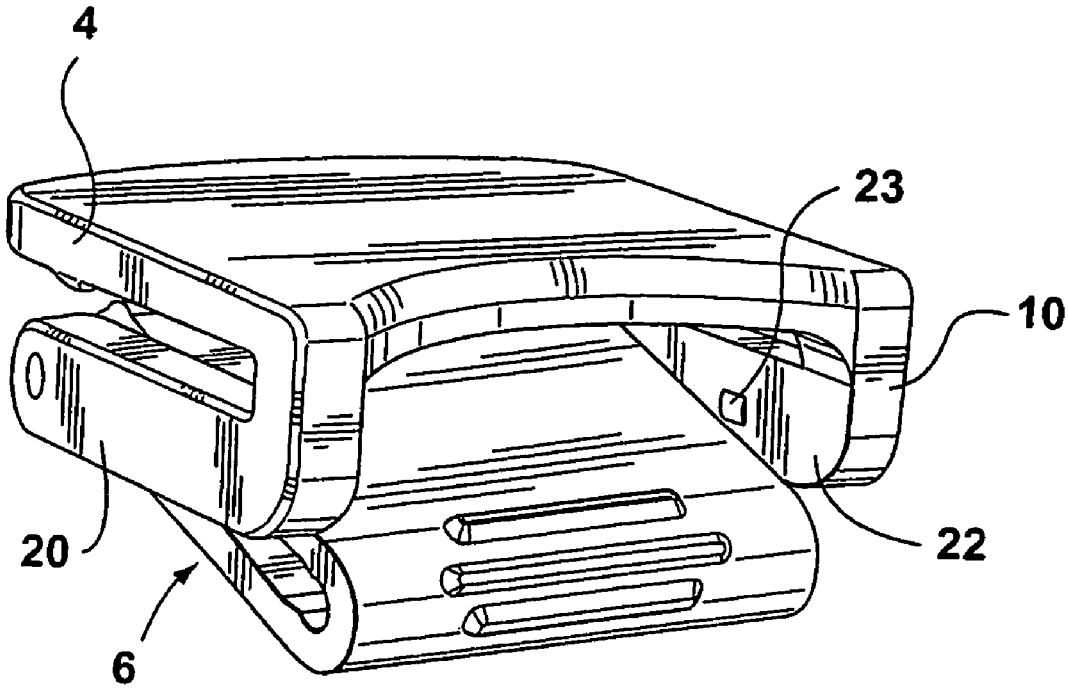
FIGS. 35*a* and 35*b* are side perspective views of another embodiment of the invention showing a clip having two reversible or rotatable cams.
Figure 35A:
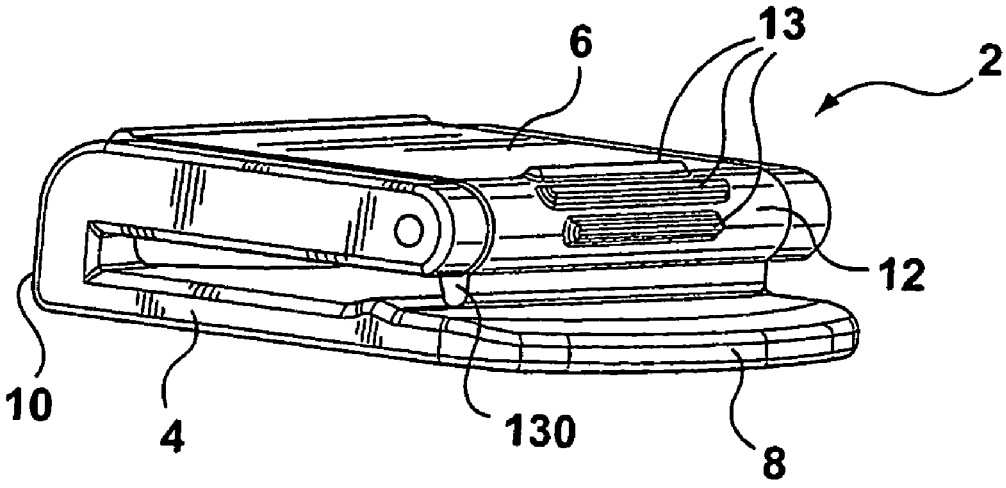

FIG. 35*a* is a side perspective view of another embodiment of the invention showing the clip 2 for securing sheet materials together (not shown). In particular the clip 2 has opposed first 4 and second 6 spaced surfaces. A first surface 4 has a forward edge 8 and a rear edge 10 while the second opposed surface 6 also has a first edge 12 and a second edge 14.

Figure 36:
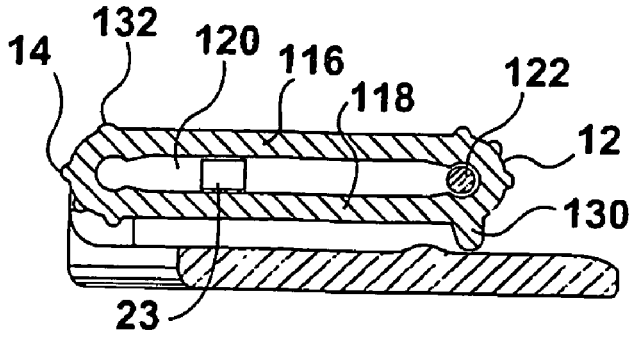
FIG. 36 is a cross-sectional view of FIG. 44 taken along the lines of 36-36.
Figure 37:
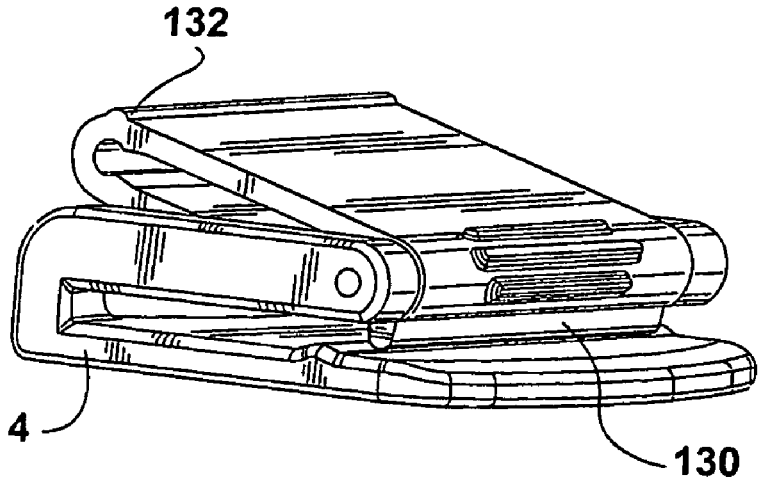
FIG. 37 is a side perspective view of FIG. 35*b* in a partially open position.
Figure 38:
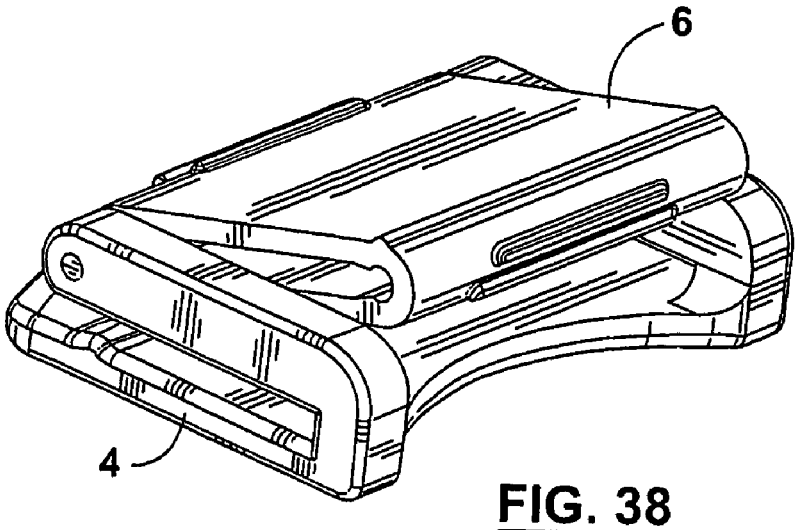
FIG. 38 is another perspective view of FIG. 35*b* in a partially open position.
Figure 39B:
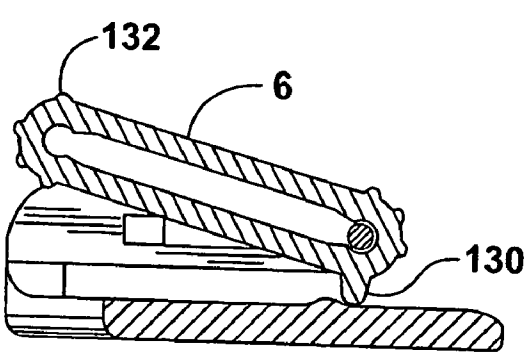
FIG. 39*b* is a cross-sectional view of FIG. 39*a* taken along the lines 39*b*-39*b*.
Figure 39A:
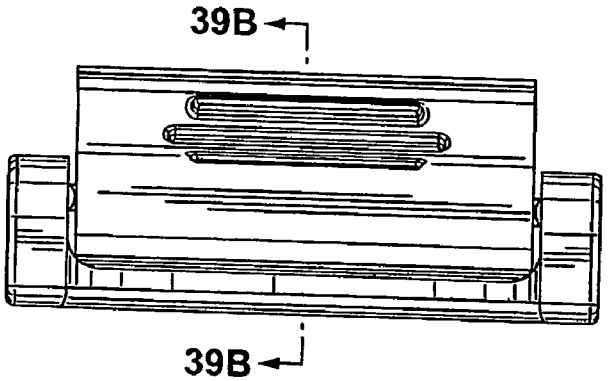
FIG. 39*a* is a front elevational view of FIG. 37.
Figure 40:
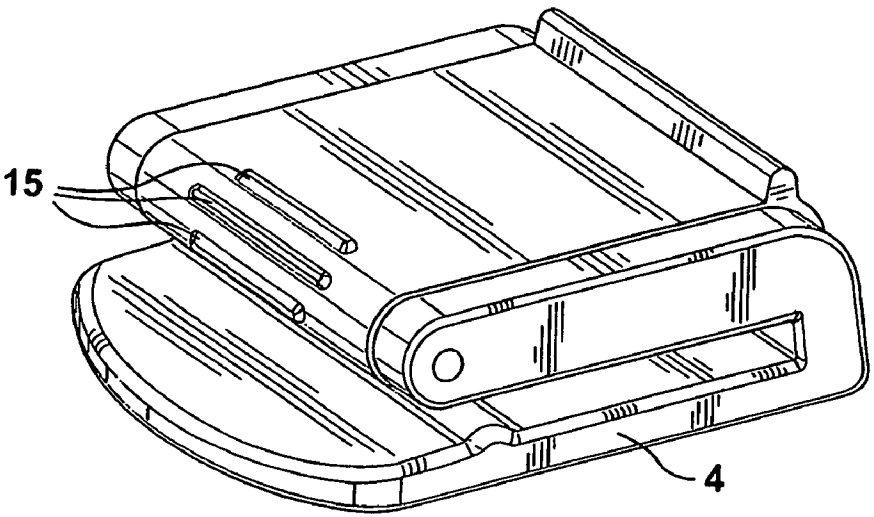
FIG. 40 is a perspective view of FIG. 35*a* in a closed position.
Figure 43:
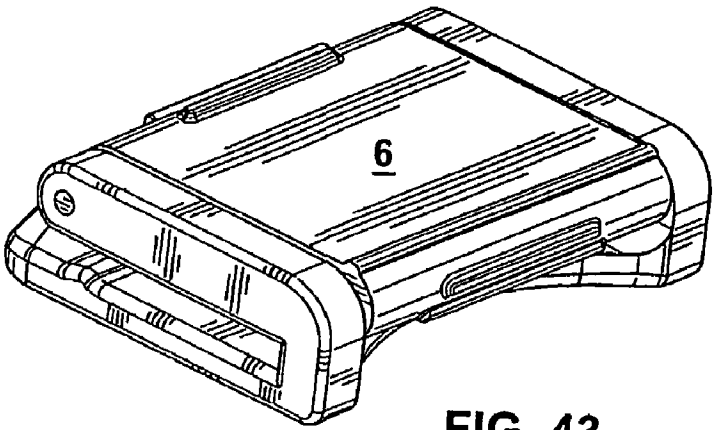
FIG. 43 is a perspective view of FIG. 35*a* from the rear.
Figure 44:
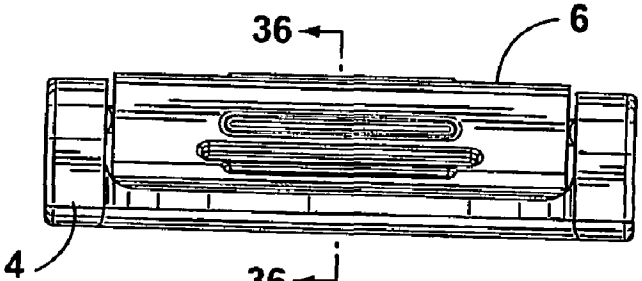
FIG. 44 is a front elevational view of FIG. 35*a*.
Figure 41:
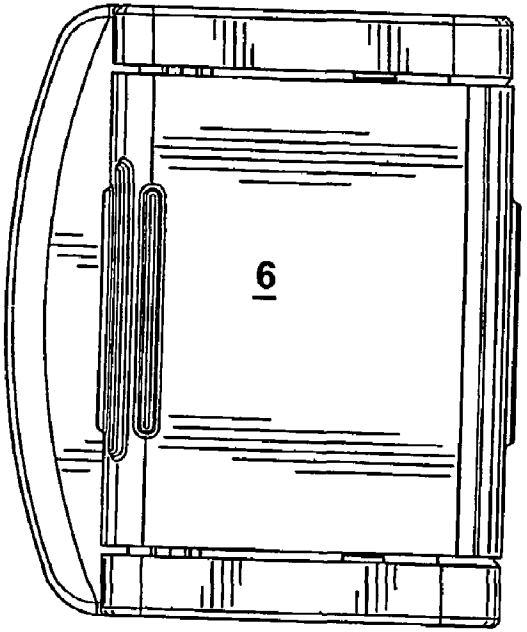
FIG. 41 is a top plan view of FIG. 35*a*.
Figure 42:
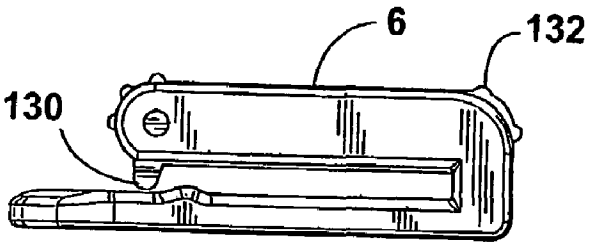
FIG. 42 is a side view of FIG. 41.
Figure 45:
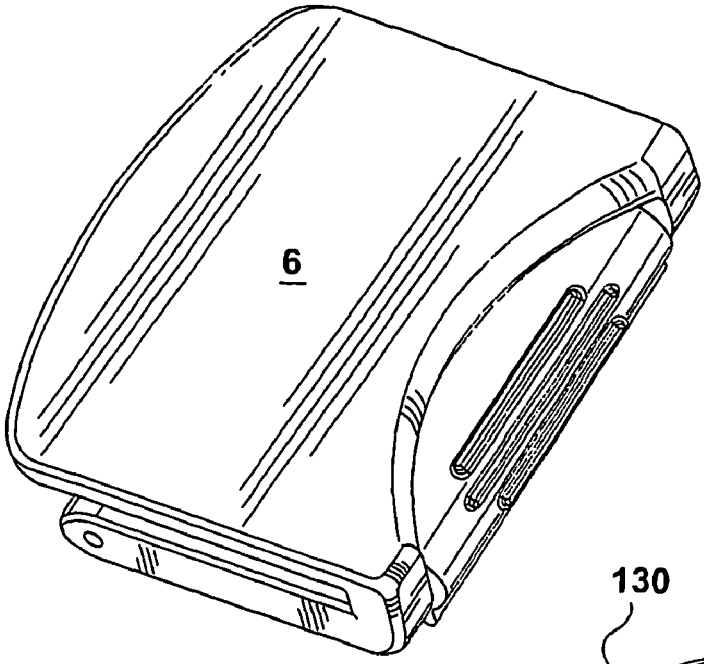
FIG. 45 is a perspective view of FIG. 35*a* in the closed position.
Figure 46:
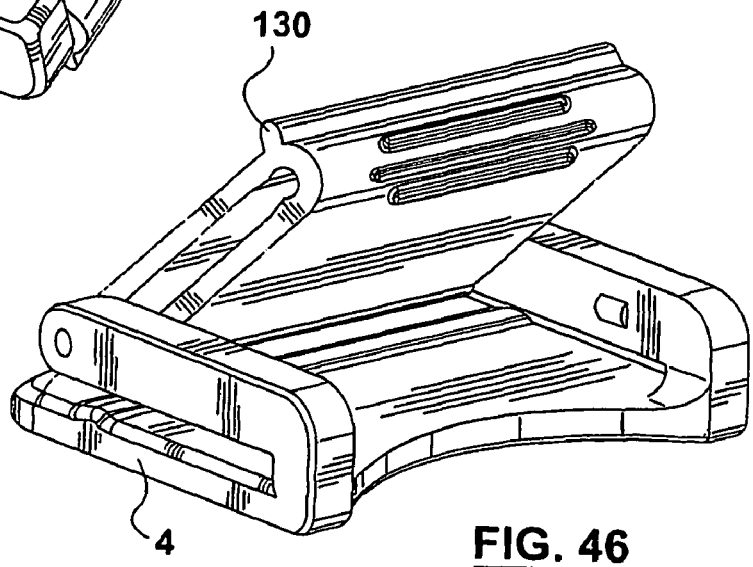
FIG. 46 is another perspective view of FIG. 35*a* in an open position.
Figure 47:
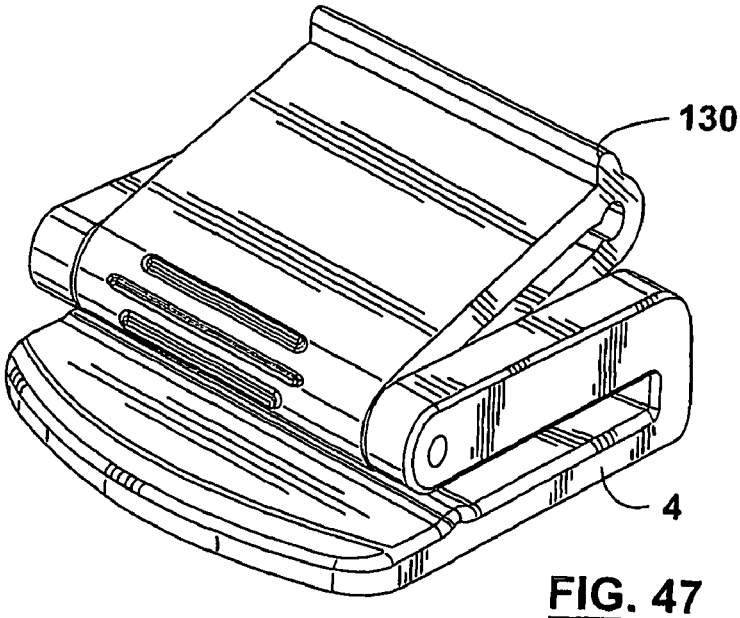
FIG. 47 is yet another perspective view of FIG. 35*a* in an open position.
Figure 48:
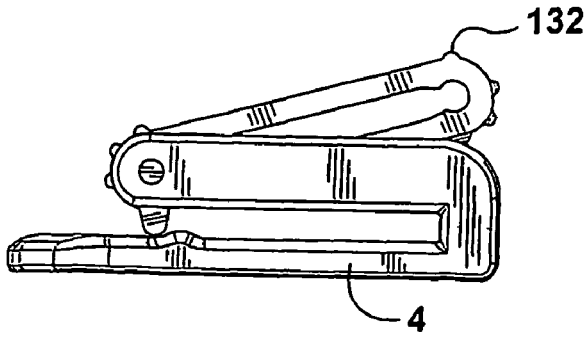
FIG. 48 is a side elevational view.
Figure 49:
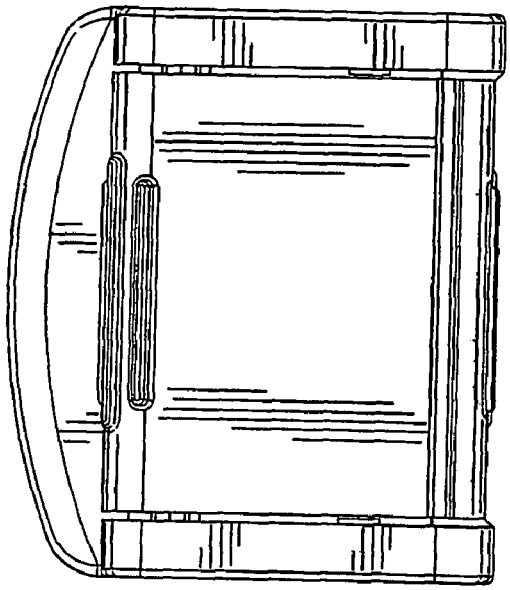
FIG. 49 is a top plan view of FIG. 37.

The second spaced surface 6 is reversible or rotatable and in one embodiment comprises a generally hollow rectangular section as best seen in FIG. 36 having a first wall 116 spaced from second wall 118 with a hollow space 120 therebetween defined by walls 116, 118 and first and second edges 12 and 14 which are adapted to receive a pin 122. The pin 122 is sized with the hollow space 120 to permit one to manipulate the second spaced surface 6 from a first closed position shown in FIG. 34 having a first cam member 130 which is sized to clamp stacked paper (not shown) between the first cam member 130 and base 4 as best illustrated in FIG. 36 to a second closed position; whereby the second surface 6 is rotated as shown in FIGS. 37, 38, 39*b* and 40 so as to present the second cam member 132 relative the base 4 and secure a second thickness of paper therebetween.

Pin 122 is captured at either end of the first and second edge 12 and 14 as shown and permits rotatable movement of the second surface 6 relative to the first surface 4 so as to permit insertion and deletion of stacked paper between the cam members 130 and 132 and the base 4.

In the embodiment shown, different thicknesses of paper can be accommodated by utilizing different sized cams 130 and 132*a* shown so as to selectively change the distance between the first and second members 4 and 6 in a closed position to thereby accommodate different stacks of paper clamped therebetween.

The arms 20 and 22 can include a slight protrusion 23 as shown which is adapted to be captured in the hollow space 120 best seen in FIG. 36. In other words, the respective walls 116 and 118 will swing past the protrusion and "snap" the protrusion in place between the walls 116 and 118. However, the walls 116 and 118 and protrusion 23 are sized so that a clip can be easily swung by an appropriate force. Also the edges 12 and 14 can include engaging ridges or ribs 13 and 15 respectively to facilitate engagement with a human figure (not 30 shown) to move the surface 6. In other words, it produces a surface which is easier to move.

Figure 50:
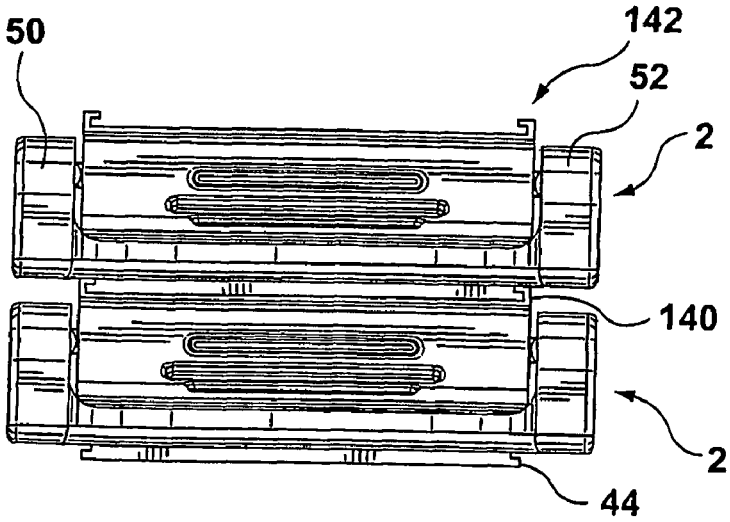
FIG. 50 illustrates the clips being stacked.
Figure 60:
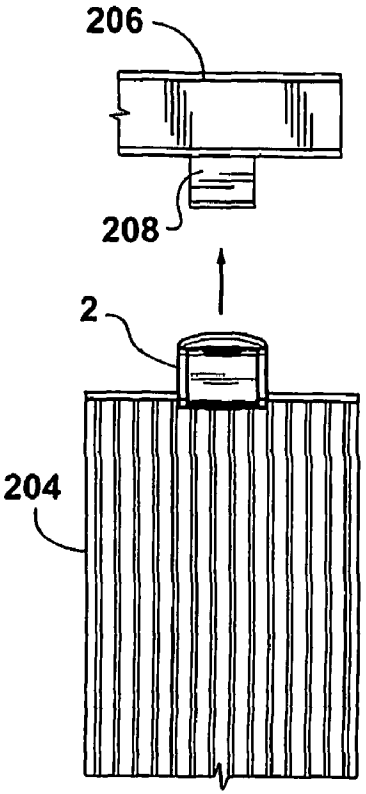
FIG. 59 and 60 illustrate a clip used on a fastener for a window blind

In another embodiment of the invention clip 2 as shown in FIG. 50 can be stacked whereby the first and second surfaces 4 and 6 include stacking means 140. In one embodiment the stacking means 140 can comprise a tongue 144 and groove 142 arrangement as shown in FIG. 50. in particular the base 4 can present the tongue 144 while the upper surface 6 can present the groove 42 adapted to slidingly receive tongue 144 and be secured thereto. Appropriately spaced dimples and recesses (not shown) can be utilized so as to snappinuly lock two stacked clips 2 together so as to increase the Thickness of paper clips to be secured therebetween.

Any number of clips 2 can be stacked in the fashion shown. The invention, however, should not be limited to the tongue and groove arrangement as other arrangements of stacking can be utilized. For example, the arms 50 and 52 can present the stackable means 40 as well.

Another embodiment of the invention shown in FIGS. 51-57 which comprises a base 4 and an opposed surface 6 having adjustable thickness means 160 so as to clamp a selected thickness of papers between the cam surface 130 and 132 as shown. In particular FIG. 53 illustrates the smallest jaw position for clamping papers between the cam surface 130 and base 4. The adjustable thickness means 160 can be utilized so as to spread apart the distance between the base 4 and first surface 6 to an intermediate jaw position as shown in FIG. 54 where the smaller sized cam 132 is spaced from base 4. Moreover the ratchet means 160 can be moved or displaced again so as to move the base 4 from the upper surface 6 to the largest jaw position as shown in FIGS. 54 and 55 between larger cam 130 and the base 4. FIGS. 53 and 56 show the clip 2-in a locked position.

FIG. 57 illustrates the embodiment in an unlocked position.

As the cams 130 and 132 are moved or displaced to the locked position the cam exerts a clamping force on the sheet material and also distorts the jaw causing it to lock in place with a tooth or similar ratchet mechanism as shown in FIG. 52. The ratchet mechanism shown in FIG. 52 permits the base 4 to move relative to the first surface 6 with the teeth 70 and 72 sliding past one another in one position and locking in another position. More specifically the base 4 includes a recess 71 having at least one set of teeth or ratchet 70. The first surface 6 includes a depend leg 75 also having a set of teeth 73 adapted to engage teeth when inserted into recess 71. Part of the recess 71 is formed by displaceable member 77 which operates the teeth 70. A displaceable member 77 is swung in the direction of arrow A the teeth 70 disengage the teeth 73 to permit withdrawal of the leg 75 from the recess 71. In this way the height H of the first surface 6 rotates base 4, and hence the thickness of sheet material to be clasped can be adjusted.

Figure 59:
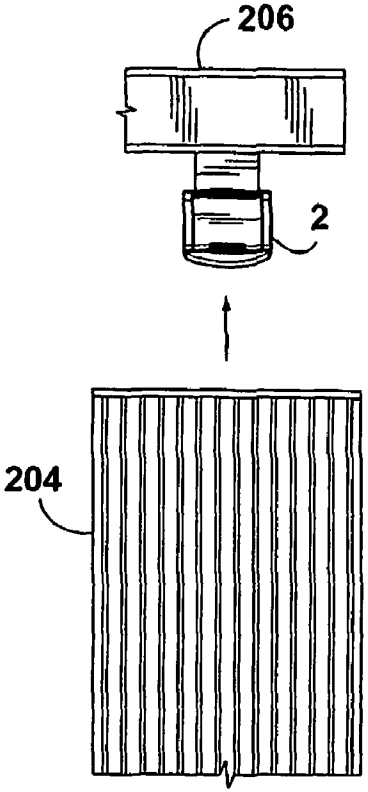
Figure 58B:
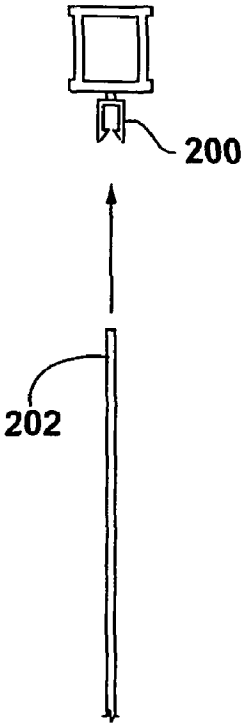
FIG. 58B (PRIOR ART)
FIG. 58*a* and 58*b* show a prior art fastener for vertical window blinds.
Figure 58A:
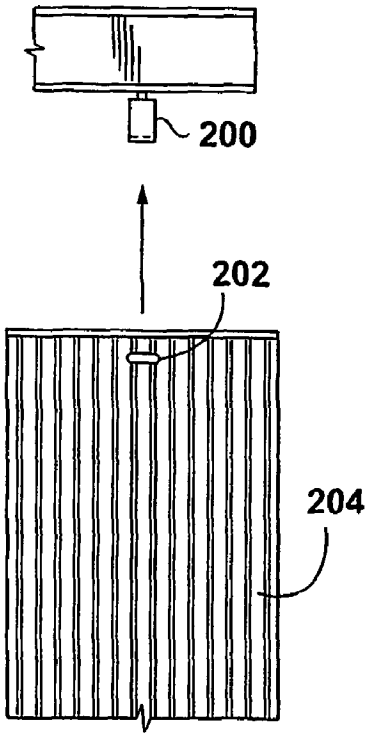
FIG. 58A (PRIOR ART)

Not only can the clip 2 be utilized to secure a plurality of sheets together, the clip 2 can also be used to secure, fasten, or hang one object to another. For example, FIGS. 58*a* and 58*b* illustrate a prior art vertical blind hanging from a headrail which is secured by a fastening element 200 to a hole 202 presented by the vertical blind 204 in a manner well known to those persons skilled in the art. FIG. 59 shows another use of the clip 2 which can hang from the headrail 266 as shown, to be secured in the manner previously described in the various embodiments to the vertical blind 204. Alternatively, the clip 2 may be carried by the vertical blind 204 so as to be secured to the extension or sheet material 208 depending from the headrail 206 in the manner shown.

Figure 61:
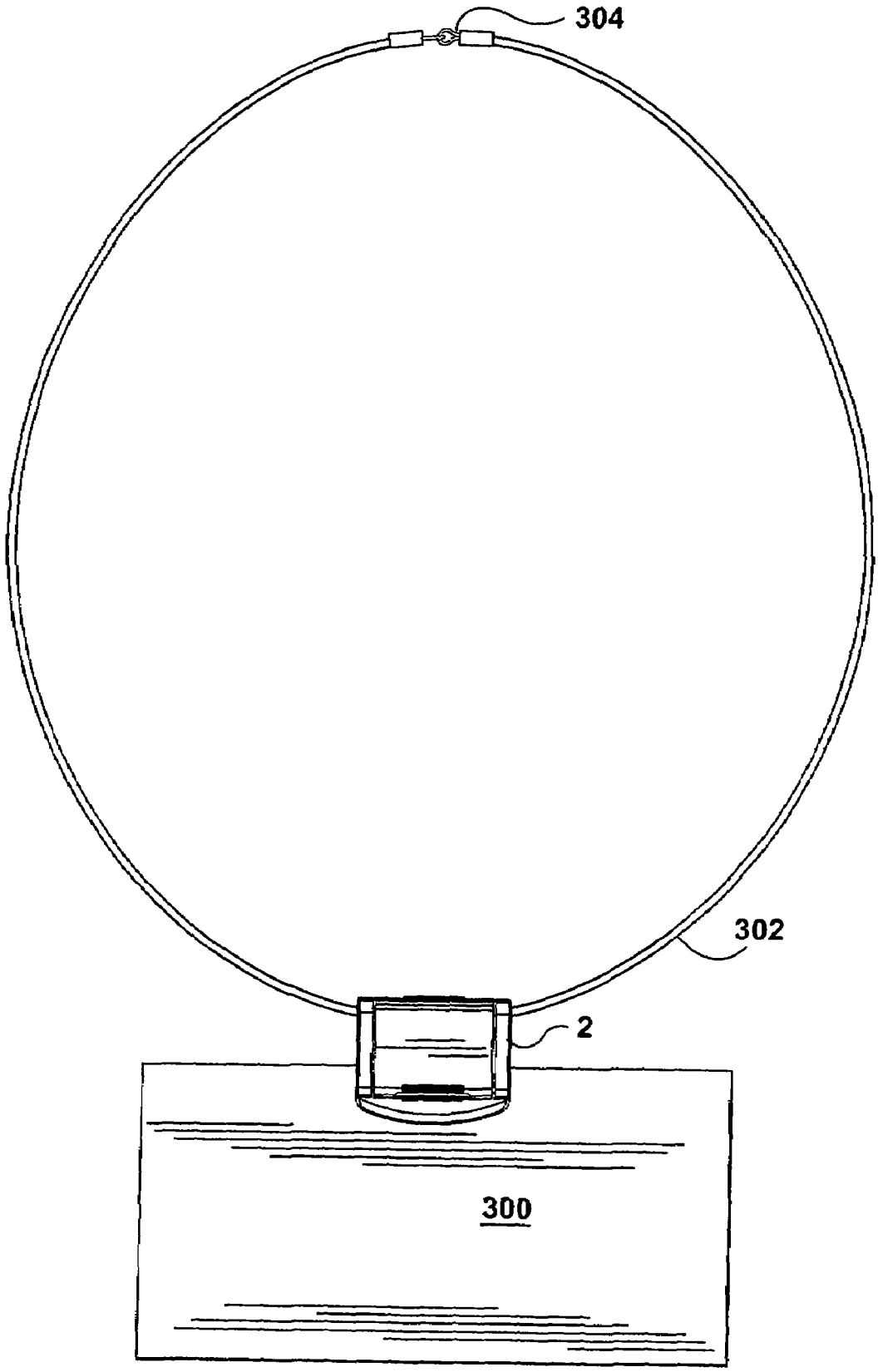
FIG. 61 illustrates the use of the clip as a name tag.

Another use of the clip 2 is illustrated in FIG. 61 whereby the clip 2 has been adapted to hold a name tag 300 which are commonly used at conferences to identify an individual. The prior art name tags which have been heretofore used can generally consist of a metallic alligator clip fastened to a clear plastic pouch carrying a name tag 300 all of which is secured to a string, rope or the like 302. Applicant's invention on the other hand comprises of an effective mechanism whereby the clip 2 is adapted to be secured to the name tag 300 and the chord or string 302 which passes through an appropriate aperture of the clip 2. The chord 302 may include fastening and unfastening means 304 or alternatively the chord 302 may be made from one piece. Furthermore the chord 302 may be fused to the clip 2 particularly when the clip 2 is fabricated from plastic. The arrangement shown in FIG. 61 illustrates a cost effective professional looking name tag which dispenses with the need for a plastic pouch, and metallic alligator clip.

Figure 62A:
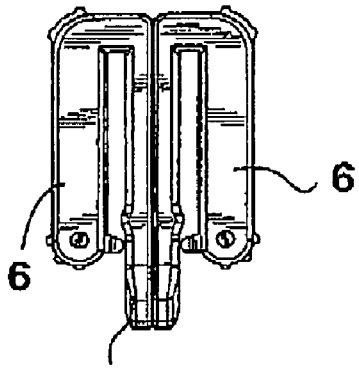
FIG. 62*a* and 62*b* illustrate other embodiments of the clip as a name tag.
Figure 62B:
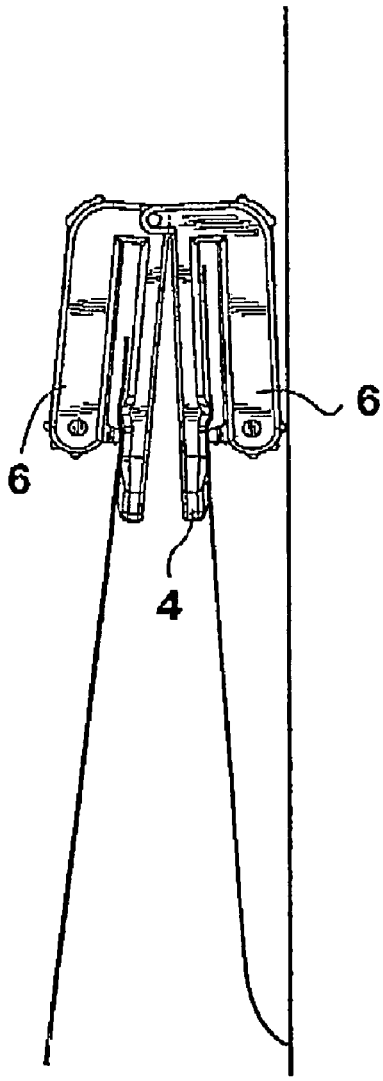

FIG. 62*a* and *b* illustrate other embodiment of the inventions whereby the clip 2 is used as a name tag or badge holder. In particular two clips 2 are utilized and are adapted to be connected together as shown in FIG. 62*a* (by means of an adhesive for example) or hinged by means of a pin 301 has shown in FIG. 62*b*. Therefore the two hinged clips 2 can articulate relative one another. Each of the clips 2 have first and second surfaces 4 and 6 has described above whereby one of the clips 2 is adapted to clamp and display the tag 300 while the other clip 2 is adapted to be secured to an appropriate spot such as a pocket 303.

Figure 63:
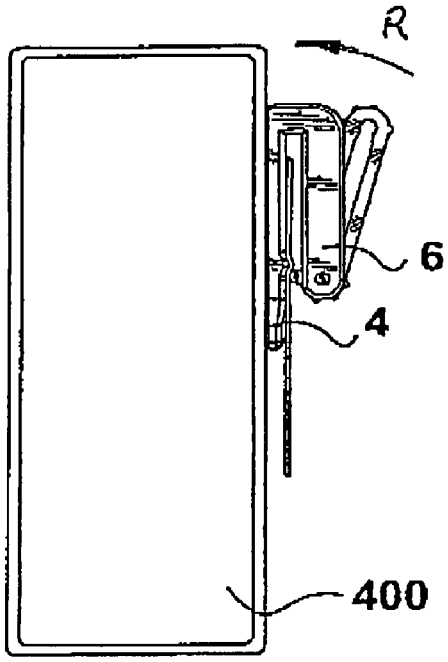
FIG. 63 is another embodiment of the invention so as to carry an electronic device, such as a communication device.

Another embodiment of the invention comprises the use of a clip 2 for carrying an electronic device 400 as illustrated in FIG. 63. The electronic device 400 can be made as small as practically possible and adapted to be carried by either the first or second surfaces 4 and 6 as required. In the illustration shown in FIG. 63, the electronic device 400 is carried by the base or first surface 4 by way of illustration. The remainder of the clip 2 works in the fashion described whereby the cam or second surface 6 maybe rotated in the direction of arrow R so as to clip to a shirt pocket 303 or belt or the like. The electronic device 400 may be secured to the clip 2 by any number of means including adhesive.

Figure 64A:
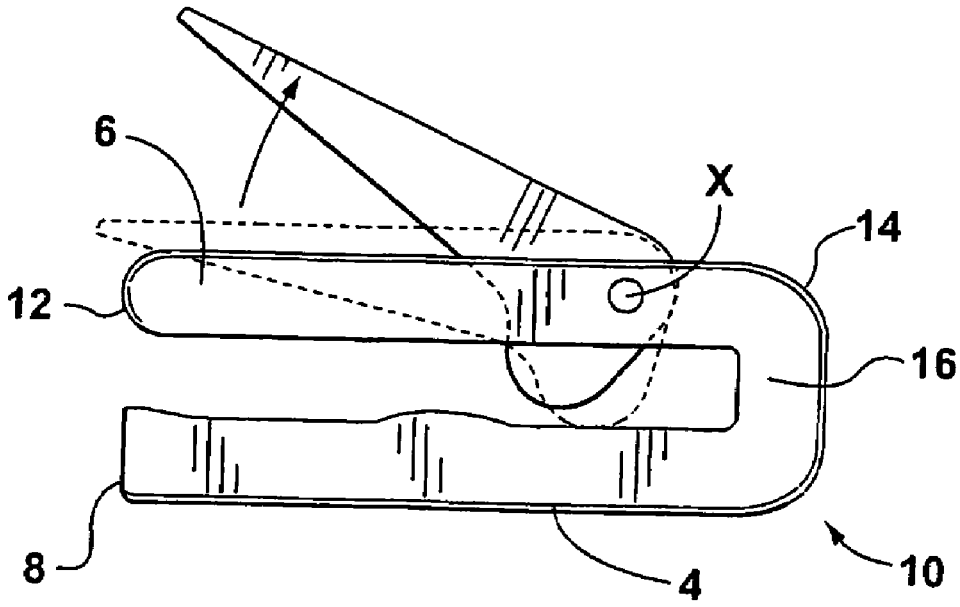
FIGS. 64*a* and 64*b* illustrate another embodiment of the invention.
Figure 64B:
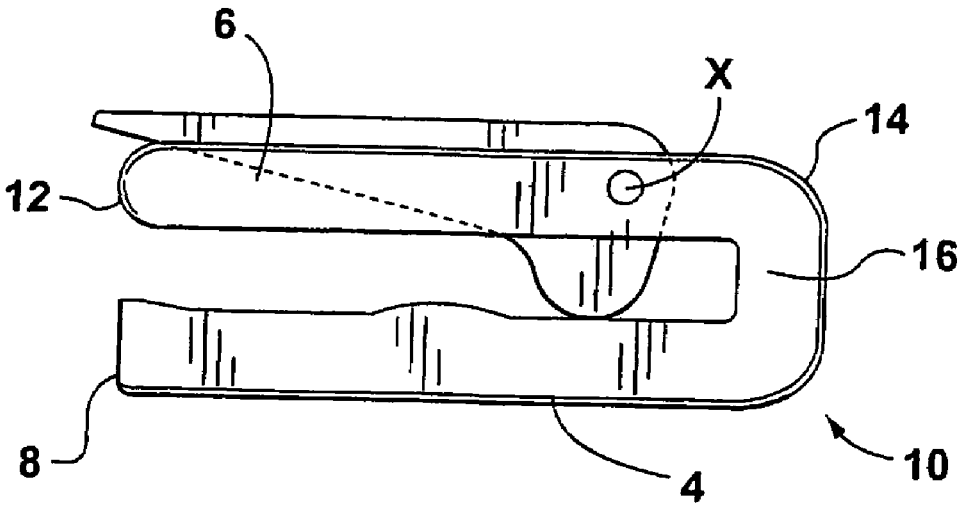

Moreover FIGS. 64*a* and 64*b* illustrates yet another embodiment of the invention whereby the cam is disposed adjacent to the connecting member 16 rather than closer to the front edges 8 and 10 as illustrated. FIG. 64*a* shows this embodiment whereby the clip 2 is an open position permitting the insertion of sheet material such as paper between the surfaces 4 15 and 6. When the cam is rotated to the closed position as shown in FIG. 64*b*, the cam member 34 will have a tendency to move, displace or push the sheet material towards the connecting member 16. Furthermore since the cam member 34 pivots or rotates about axis X which is close to the connecting member 16 the clip as shown will exhibit good resistance to any tendency to spread apart the space between the forward edges 8 and 12 of first and second members 4 and 6 respectively.

Furthermore the clip 2 can be comprised of different materials selected to exhibit different properties. For example, the cam member 34 can be made of a material having a low co-efficient of friction so as to slide over the paper and into place without pushing the paper out of the clip 2; while a different material can be made for the frame having for example increased flexibility or spring properties so that the jaw (i.e. the space between the forward edges 8 and 12) of the clip 2 can expand to hold more paper and add to the holding force provided by the cam 30.

Various embodiments of the invention have now been described in detail. Since changes in and/or additions to the above-described best mode may be made without departing from the nature, spirit or scope of the invention, the invention is not to be limited to said details.

I claim:

1. A method of clamping paper in a paper clip having spaced first and second opposed surfaces, each first and second opposed surface having a forward and rear edge, and connected together, at said rear edge, and a cam member having a tab at one end thereof and a cam surface at another end thereof comprising the steps of:

(a) moving said tab to a first open position where said cam surface is displaced away from said first surface;

(b) inserting said paper through said forward edge between the said first and second opposed surfaces;

(c) moving said tab to a closed position whereby said cam surface is displaced towards said first surface to clamp said paper between said cam surface and said second opposed surface;

(d) wherein said cam surface is rotatably and pivotally moved between said open and closed positions;

(e) wherein said first and second opposed surfaces and said cam member are comprised of resiliently deformable material for accommodating different thickness of paper when said cam surface is moved from said open to said closed positions;

(f) wherein said first and second opposed surfaces comprises a bent wire which deforms when said cam member moves from said open to said closed position so as to clamp said paper between said cam surface and said bent wire.

2. A method of clamping paper in a paper clip having spaced first and second opposed surfaces, each first and second opposed surface having a forward and rear edge, and connected together at said rear edge, and a cam member having a tab at one end thereof and a cam surface at another end thereof comprising the steps of:

(a) moving said tab to a first open position where said cam surface is displaced away from said first surface;

(b) inserting said paper through said forward edge between the said first and second opposed surfaces;

(c) moving said tab to a closed position whereby said cam surface is displaced towards said first surface to clamp said paper between said cam surface and said second opposed surface;

(d) stacking a plurality of said paper clips so as to accommodate the clamping of different thicknesses of said paper.

3. A method as claimed in claim 2 wherein each of said paper clips includes connecting means for stackingly connecting said plurality of paper clips.

4. A method as claimed in claim 2 wherein said paper clip includes ratcheting means for increasing the distance between said cam surface and said first surface so as to clamp different thickness of said paper between said cam surface and said first surface when moving said cam between said open and closed positions.

5. A method as claimed in claim 2 wherein said tab member includes a first cam surface and a second cam surface whereby said tab member is movable so as to present said first cam surface for clamping a first thickness of paper between said first cam surface and said first surface and, for moving a second cam surface for clamping a second thickness of paper between said second cam surface and said first surface.

* * * * *